US010789929B2

(12) United States Patent
Hakuta et al.

(10) Patent No.: US 10,789,929 B2
(45) Date of Patent: Sep. 29, 2020

(54) SOUNDPROOF STRUCTURE AND SOUNDPROOF SYSTEM

(71) Applicant: FUJIFILM Corporation, Tokyo (JP)

(72) Inventors: Shinya Hakuta, Ashigara-kami-gun (JP); Shogo Yamazoe, Ashigara-kami-gun (JP)

(73) Assignee: FUJIFILM Corporation, Minato-Ku, Tokyo (JP)

( * ) Notice: Subject to any disclaimer, the term of this patent is extended or adjusted under 35 U.S.C. 154(b) by 0 days.

(21) Appl. No.: 16/296,499

(22) Filed: Mar. 8, 2019

(65) Prior Publication Data

US 2019/0206380 A1 Jul. 4, 2019

Related U.S. Application Data

(63) Continuation of application No. PCT/JP2017/030952, filed on Aug. 29, 2017.

(30) Foreign Application Priority Data

Sep. 13, 2016 (JP) ..... 2016-178654

(51) Int. Cl.
*G10K 11/162* (2006.01)
*F24F 13/24* (2006.01)
(Continued)

(52) U.S. Cl.
CPC ..... *G10K 11/162* (2013.01); *E04B 1/84* (2013.01); *F24F 13/02* (2013.01); *F24F 13/24* (2013.01); *G10K 11/16* (2013.01); *G10K 11/172* (2013.01)

(58) Field of Classification Search
CPC .... G10K 11/162; G10K 11/16; G10K 11/172; E04B 1/84; F24F 13/02; F24F 13/24
(Continued)

(56) References Cited

U.S. PATENT DOCUMENTS 3,983,955 A 10/1976 Vasiljevic
10,373,599 B2 * 8/2019 Hakuta ..... G10K 11/162
(Continued)

FOREIGN PATENT DOCUMENTS

CN 101278336 A 10/2008
CN 103807996 A 5/2014
(Continued)

OTHER PUBLICATIONS

International Search Report for PCT/JP2017/030952 dated Nov. 7, 2017 (PCT/ISA/210).
(Continued)

*Primary Examiner* — Forrest M Phillips
(74) *Attorney, Agent, or Firm* — Sughrue Mion, PLLC

(57) ABSTRACT

A soundproof structure has two or more soundproof units. Each of the soundproof units has an outer shell having a cylindrical shape, has a hollow inner space inside the outer shell, and has a first opening portion opened to outside on a surface that is one end portion of the outer shell in an axis direction of the cylindrical shape. The two soundproof units adjacent to each other are disposed in the axis direction such that the first opening portions face each other. The first opening portions facing each other are spaced apart from each other in the axis direction. An average distance in the axis direction between the first opening portions facing each other is less than 20 mm. Accordingly, there are provided a soundproof structure and a soundproof system which can insulate sounds on the low frequency side with a simple configuration, are small and lightweight, and can easily change the frequency characteristics.

20 Claims, 16 Drawing Sheets

(51) Int. Cl.

| | |
|---|---|
| ***F24F 13/02*** | (2006.01) |
| ***G10K 11/172*** | (2006.01) |
| ***G10K 11/16*** | (2006.01) |
| ***E04B 1/84*** | (2006.01) |

(58) Field of Classification Search
USPC ..... 181/284
See application file for complete search history.

(56) References Cited

U.S. PATENT DOCUMENTS

| | | | | |
|---|---|---|---|---|
| 2008/0128200 | A1* | 6/2008 | Tsugihashi | B60J 5/0418 181/284 |
| 2009/0084627 | A1* | 4/2009 | Tsugihashi | B60J 5/00 181/290 |
| 2009/0283356 | A1* | 11/2009 | Tsugihashi | F04B 39/0027 181/207 |

FOREIGN PATENT DOCUMENTS

| | | | |
|---|---|---|---|
| CN | 104299608 | A | 1/2015 |
| CN | 103807996 | B | 8/2016 |
| JP | 876773 | A | 3/1996 |
| JP | 11153995 | A | 6/1999 |
| JP | 2000-234315 | A | 8/2000 |
| JP | 2003-177759 | A | 6/2003 |
| JP | 2003-216159 | A | 7/2003 |
| JP | 3831263 | B2 | 10/2006 |
| JP | 3893053 | B2 | 3/2007 |
| JP | 2010-085989 | A | 4/2010 |
| JP | 2010-097149 | A | 4/2010 |
| JP | 2011-241583 | A | 12/2011 |
| JP | 2013-125186 | A | 6/2013 |
| JP | 2015-184524 | A | 10/2015 |
| JP | 2016-069132 | A | 5/2016 |

OTHER PUBLICATIONS

Written Opinion for PCT/JP2017/030952 dated Nov. 7, 2017 (PCT/ISA/237).

International Preliminary Report on Patentability (with translation of the Written Opinion) dated Mar. 19, 2019, issued by the International Bureau in application No. PCT/JP2017/030952.

Communication dated Aug. 7, 2019, from the State Intellectual Property Office of the P.R.C in application No. 201780055968.6.

Communication dated Oct. 25, 2019, from the European Patent Office in application No. 17850683.8.

Partial Supplementary European Search Report dated Aug. 19, 2019 issued by the European Patent Office in counterpart application No. 17850683.8.

Communication dated Dec. 18, 2019, from the China National Intellectual Property Administration in Application No. 201780055968.6.

Communication dated Jun. 8, 2020, from the European Patent Office in Application No. 17850683.8.

* cited by examiner

SOUNDPROOF STRUCTURE AND SOUNDPROOF SYSTEM

CROSS-REFERENCE TO RELATED APPLICATIONS

This application is a Continuation of PCT International Application No. PCT/JP2017/030952 filed on Aug. 29, 2017, which claims priority under 35 U.S.C. § 119(a) to Japanese Patent Application No. 2016-178654 filed on Sep. 13, 2016. The above application is hereby expressly incorporated by reference, in its entirety, into the present application.

BACKGROUND OF THE INVENTION

1. Field of the Invention

The present invention relates to a soundproof structure and a soundproof system. More specifically, the present invention relates to a soundproof system that insulates sounds on the low frequency side with a simple configuration by arranging two soundproof units, each of which has an outer shell having a cylindrical shape, has a hollow inner space inside the outer shell, and has a first opening portion opened to the outside on a surface that is one end portion of the outer shell in the axis direction of the cylindrical shape, close to each other so that the first opening portions face each other. That is, the present invention relates to a small soundproof structure for selectively strongly shielding sound with a lower frequency as a target. In addition, the present invention relates to a soundproof system capable of easily adjusting the center frequency of soundproofing using such a soundproof structure.

2. Description of the Related Art

Conventionally, since noise emitted from industrial and commercial equipment such as motors, pumps, air conditioning equipment, and ducts, transportation equipment such as automobiles, general household equipment such as air conditioners, and the like causes environmental degradation, various soundproof materials for reducing such noise have been used.

As such soundproof materials, sound absorbing materials have conventionally been used. For example, the absorbance of a common sound absorbing material formed of a fiber material, such as urethane, is determined by the ratio between the size of the sound absorbing material and the sound wavelength. Also in film type sound absorbing materials or sound absorbing materials that absorb sound using resonance, such as Helmholtz resonance, the soundproofing frequency is determined by the size of the rear volume. In these sound absorbing materials, the high frequency side can be soundproofed even with relatively small size and light weight, but a heavy weight and a large size are required for the low frequency side. In addition, in order to change the soundproofing target frequency, it is necessary to change the rear volume or to change the hardness of the film. For this reason, it has been difficult to perform fine adjustment of the frequency easily.

As such a soundproof structure using a sound absorbing material using resonance, for example, JP3893053B discloses a ventilation type sound insulation wall structure in which a channel member assembly is formed by combining a pair of channel members each having an approximately C-shaped cross section such that the opening sides of the channel members face each other with a gap therebetween, a plurality of channel member assemblies are provided side by side within a duct, a ventilation portion is formed between the channel member assemblies, the opening side of the pair of channel members is a ventilation groove, and a resonance chamber communicating with the ventilation portion through the ventilation groove is formed inside the pair of channel members.

In this ventilation type sound insulation wall structure, a resonance chamber communicating with an external ventilation portion through the ventilation groove serving as a slit is formed in a pair of channel members of the channel member assembly. In the resonance chamber, a resonance wave having an opposite phase to noise, which is incident from a noise source and passes through the ventilation groove (slit), so as to cancel each other is generated by using slit resonance (slit Helmholtz resonance) and the volume of the inside. Therefore, sound insulation is performed after securing ventilation. Thus, in the ventilation type sound insulation wall structure disclosed in JP3893053B, a resonance frequency (that is, a sound insulation (sound absorption) frequency) generated in the resonance chamber is changed by changing the volume of the resonance chamber or by appropriately selecting the groove width of the ventilation groove, so that it is possible to cope with noise of a wide frequency range from low-frequency noise to high-frequency noise emitted by the noise source. In JP3893053B, for example, by increasing the volume of the resonance chamber or by setting the groove width of the ventilation groove to be small, the resonance frequency, that is, the sound insulation (sound absorption) frequency can be lowered to insulate the low-frequency noise.

JP3831263B discloses a duct muffler that is a group of acoustic tubes obtained by arranging a plurality of acoustic tubes, each of which is a rectangular tube having a length of ¼ of the wavelength of each of a plurality of sound waves forming a main component of noise and having a closed end, side by side on the inner surface of the duct over about a half wavelength of the target sound wave in the length direction of the duct.

In JP3831263B, a plurality of rectangular tubes (acoustic tubes) are disposed at the wall surface boundary corresponding to the opposite inner surface of the duct so that the openings of the rectangular tubes serving as acoustic tubes are arranged at positions corresponding to the inner surface of the duct, and the shape of the wavefront on the inner surface of the duct is changed using air column resonance with the length being ¼ of the wavelength of the sound wave, so that a wavefront that is a soft boundary surface where the sound pressure is approximately zero is realized on the inner surface of the duct. In this manner, it is possible to obtain a large noise reduction effect without causing the propagation of sound waves on the inner surface of the duct.

SUMMARY OF THE INVENTION

Incidentally, it is well known that it is difficult to absorb low-frequency sound with a common broadband soundproof material that is, for example, a fiber material such as urethane or glass wool.

As in JP3893053B, in the case of a sound absorbing material that uses slit Helmholtz resonance by arranging a pair of channel members each having an approximately C-shaped cross section close to each other, the sound pressure decreases in the channel direction (horizontal direction) of the channel member. For this reason, air column resonance hardly occurs, and the channel member alone absorbs almost no sound. Therefore, since the absorption effect by Slit Helmholtz appears for the first time by bringing a pair of channel members each having an approximately C-shaped cross section close to each other, there is a problem that the absorption is not shifted to the high frequency side but becomes small in a case where the distance is increased and accordingly a function as a sound absorbing body is not realized. In addition, in a case where the required sound absorption amount is large to some extent, it is necessary to increase the volume of the resonance chamber as the frequency of the sound to be absorbed becomes lower. Therefore, there is a problem that the structure size increases.

In the invention disclosed in JP3893053B, the frequency can also be shifted to the low frequency side by reducing the slit width (groove width) in the slit resonance. However, in the slit resonance, the sound absorbing portion is friction due to the slit (ventilation groove), and the amount of friction is determined by the thickness of the wall of the slit and the groove width. Therefore, for a large amount of absorption and absorption on the low frequency side, it is necessary to increase the thickness of the wall. For this reason, there is a problem that the structure becomes larger and heavier. In addition, as the groove width increases, the absorption amount of the slit Helmholtz phenomenon rapidly decreases. Therefore, it is necessary to keep the groove width small to some extent. As a result, there is a problem that the frequency shift amount is small.

In JP3831263B, in order to make the sound pressure on the duct wall be approximately zero by changing the shape of the wavefront on the inner surface of the duct in the air column resonance phenomenon, a pair of assemblies, each of which includes a plurality of acoustic tubes each having a length of ½ of the wavelength so that the openings of the acoustic tubes are disposed so as to face the inner surface of the duct, are used. In a case where the size of the duct itself is reduced, wind or heat hardly passes through the duct due to friction. Therefore, there is a problem that it is not possible to dispose assemblies of a plurality of acoustic tubes close to each other.

In JP3831263B, it is necessary to create a wavefront at which the duct end portion becomes a soft boundary by securing the distance between acoustic tubes that are air column resonance tubes. For this reason, in a case where there is an interaction between the acoustic tubes facing each other, the wavefront is affected. Therefore, since it is necessary to use the assemblies in a state in which the interaction between the acoustic tubes is small, that is, in a situation in which the tube size of the duct is large to some extent, there is also a problem that the acoustic tubes cannot be brought close to each other.

In addition, since the structure requires a length of about ½ of the wavelength, there is also a problem that the size becomes very large particularly on the low frequency side.

Space and weight reduction are important issues in equipment soundproofing (office equipment, commercial equipment, industrial equipment, transportation equipment, household equipment, and the like), building materials, and the like. As a result, there has been a problem that soundproofing on the low frequency side is difficult. Therefore, a technique that enables soundproofing on the lower frequency side with the same size as in the related art has been demanded.

In equipment soundproofing, there are noise variations due to individual differences of equipment or frequency changes of noise due to aged deterioration, and various frequencies are also present in general noise. In contrast, in conventional soundproof materials, there has been a problem that it is necessary to change an amount that cannot be easily adjusted, such as the size, tension, and/or hole diameter, for the soundproofing frequency. Therefore, a mechanism for easily adjusting the soundproofing frequency has been demanded.

It is an object of the present invention to provide a soundproof structure which can insulate sounds on the low frequency side with a simple configuration, that is, selectively strongly shield sounds with lower frequencies as a target, without using a sound absorbing material such as a fiber material, which is small and lightweight, and which can easily change the frequency characteristics by solving the problems the above-described conventional technique.

In addition to the object described above, it is another object of the present invention to provide a soundproof system capable of easily adjusting the center frequency of sound insulation according to the external noise environment by using such a soundproof structure.

In the present invention, "soundproof" includes the meaning of both "sound insulation" and "sound absorption" as acoustic characteristics, but in particular, refers to "sound insulation". "Sound insulation" refers to "shielding sound", that is, "not allowing sound to pass through". Therefore, "sound insulation" includes "reflecting" sound (reflection of sound) and "absorbing" sound (absorption of sound) (refer to Sanseido Daijibin (Third Edition) and http://www.onzai.or.jp/question/soundproof.html and http://www.onzai.or.jp/pdf /new/gijutsu201312_3.pdf on the web page of the Japan Acoustological Materials Society).

Hereinafter, basically, "sound insulation" and "shielding" are referred to in a case where "reflection" and "absorption" are not distinguished from each other, and "reflection" and "absorption" are referred to in a case where "reflection" and "absorption" are distinguished from each other.

In order to achieve the aforementioned object, a soundproof structure according to a first aspect of the present invention is a soundproof structure comprising two or more soundproof units. Each of the soundproof units has an outer shell having a cylindrical shape, has a hollow inner space inside the outer shell, and has a first opening portion opened to outside on a surface that is one end portion of the outer shell in an axis direction of the cylindrical shape. The two soundproof units adjacent to each other are disposed in the axis direction such that the first opening portions face each other. The first opening portions facing each other are spaced apart from each other in the axis direction. An average distance in the axis direction between the first opening portions facing each other is less than 20 mm.

Here, it is preferable that a lid member that separates the inner space from the outside is provided on a surface that is the other end portion of the outer shell in the axis direction of the cylindrical shape, and it is preferable that the lid member blocks the inner space of the outer shell from the outer space.

It is preferable that a second opening portion smaller in size than the first opening portion is provided on a surface that is the other end portion of the outer shell in the axis direction of the cylindrical shape.

It is preferable that the outer shell blocks the inner space from the outside except for two surfaces that are both end portions of the outer shell in the axis direction of the cylindrical shape.

It is preferable that the outer shell has one or more second opening portions smaller in size than the first opening portions.

It is preferable that the soundproof structure is a structure in which the inner space and the outside are connected to each other through the first opening portion so as to be able to transmit a gas propagating sound and is a structure that causes a resonance phenomenon with respect to a sound flowing through the first opening portion.

It is preferable that the soundproof unit causes air column resonance of an approximately closed tube with respect to sound, as the resonance phenomenon, by the inner space and the first opening portion.

It is preferable that the outer shell of the soundproof unit is formed of the same material. Alternatively, the outer shell of the soundproof unit may be formed of a material that does not transmit sound as a gas propagating sound.

It is preferable to further comprise a duct-shaped member that has a space thereinside, and it is preferable that the two or more soundproof units are disposed inside the duct-shaped member.

It is preferable that the two or more soundproof units are disposed on a wall.

It is preferable to further comprise a moving mechanism that moves the first opening portion of one of the two adjacent soundproof units relative to the first opening portion of the other soundproof unit. It is preferable that the moving mechanism changes a distance between the first opening portions of the two adjacent soundproof units.

It is preferable that the moving mechanism is a rail traveling mechanism comprising a rail and a wheel on which at least one of the two adjacent soundproof units is mounted and which travels on the rail.

It is preferable that the moving mechanism is a screw moving mechanism, which comprises a ball screw and a nut to which at least one of the two adjacent soundproof units is attached and which is screwed to the ball screw, or a rack to which at least one of the two adjacent soundproof units is attached and a rack and pinion mechanism with pinion engaged with the rack.

In addition, in order to achieve the aforementioned object, a soundproof system according to a second aspect of the present invention comprises: the soundproof structure according to the first aspect described above; a measurement unit that measures noise in a surrounding environment of the soundproof structure; and an analysis unit that analyzes a frequency of noise measured by the measurement unit. A distance between the first opening portions of the two adjacent soundproof units is changed according to an analysis result of the analysis unit.

Here, it is preferable that a soundproof mechanism is a soundproof structure comprising the moving mechanism. It is preferable that the moving mechanism is an automatic moving mechanism further comprising a driving source and a control unit that controls driving of the driving source. It is preferable that the analysis unit determines a movement amount of at least one of the two adjacent soundproof units according to the analysis result. It is preferable that the control unit controls the driving of the driving source according to the determined movement amount to automatically move at least one of the two adjacent soundproof units such that a distance between the first opening portions of the two adjacent soundproof units is changed.

It is preferable to further comprise a plurality of the measurement units. It is preferable that the analysis unit analyzes the frequency of noise measured by each of the plurality of measurement units and determines the movement amount of at least one of the two adjacent soundproof units according to the analysis result.

According to the present invention, it is possible to insulate sound on the low frequency side with a simple configuration. That is, according to the present invention, it is possible to selectively strongly shield target sounds having lower frequencies, realize reductions in size and weight, and easily change its frequency characteristics.

In addition, according to the present invention, it is possible to easily adjust the center frequency of soundproofing according to the external noise environment.

DESCRIPTION OF THE PREFERRED EMBODIMENTS

Figure 1:
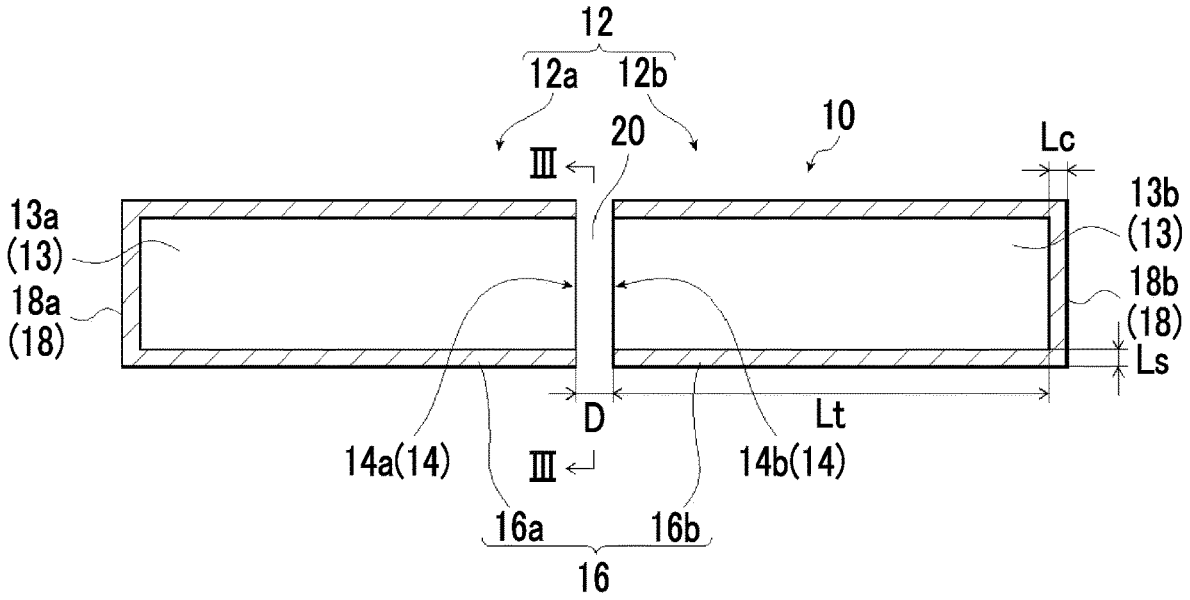
FIG. 1 is a cross-sectional view schematically showing an example of a soundproof structure according to an embodiment of the present invention.

Hereinafter, a soundproof structure and a soundproof system according to the embodiment of the present invention will be described in detail with reference to preferred embodiments shown in the accompanying diagrams.

The soundproof structure according to the embodiment of the present invention is characterized in that the resonance frequency is shifted to the low frequency side by arranging opening portions of soundproof units each having a cylindrical outer shell, which has a hollow inner space thereinside and comprises an opening portion opened to the outside on a surface that is one end portion, close to each other less than 20 mm, so that it is possible to insulate sounds on the low frequency side with the same volume.

According to the present invention, it is possible to insulate sounds on the low frequency side (that is, selectively strongly shield low-frequency sounds) with a simple configuration, realize reductions in size and weight, and easily change the frequency characteristics.

In addition, according to the present invention, it is possible to easily adjust the center frequency of soundproofing according to the external noise environment.

Air column resonance is a well-known resonance phenomenon in the field of sound, and is a phenomenon in which resonance occurs in a case where the length obtained by performing opening end correction for the length of the cylinder (tube) matches the length of ¼ (wavelength/4) of the wavelength in a one side open and one side closed cylindrical structure (for example, a cylindrical structure (for example, an air column resonance tube) of a one side closed tube or a cylindrical structure in which five surfaces of a quadrangular prismatic tube having a quadrangular cross section are closed and only one surface is open). At this time, in the air column resonance tube, absorption or reflection of sound occurs due to strong resonance in the tube. In a structure using the air column resonance tube, since only a cylindrical structure is necessary, the configuration can be made very simple and strong. In such a structure, sound is absorbed by the entire tube without having a specific thin film absorption structure, a micro through-hole, or the like. Therefore, since no load is applied to only a specific thin sound absorbing portion, durability can also be increased. In addition, since there is no specific thin sound absorbing structure, the absorption frequency or the absorbance depends on the size of the entire cylinder. Therefore, there is a merit that the robustness with respect to the size is relatively large. On the other hand, as a problem at the time of use for soundproofing or muffling, since the length of the cylinder is on the order of a ¼ wavelength, the structure becomes very large especially for use for muffling on the low frequency side. (For example, in a structure using a vibration film type sound absorbing material, a Helmholtz resonance type sound absorbing body, or the like, sound absorption can be realized with a structure smaller than ¼ wavelength by using the phase change of the vibration film and the through-hole).

The present invention is an invention capable of insulating sounds on the low frequency side with a compact structure by preparing the cylindrical structures of the one side closed tubes described above and bringing opening portions thereof close to each other so that the resonance frequency is shifted to the low frequency side.

In the present invention, the frequency amount shifted to the low frequency side depends on the distance between two first opening portions, and shifting to the low frequency side increases as the distance decreases. Accordingly, there is also a feature that a soundproofing frequency can be adjusted simply by adjusting the distance between the two first opening portions. Therefore, by combining a distance adjusting mechanism, such as a rail, as a soundproof unit moving mechanism, it is possible to easily change the soundproofing frequency. In addition, by measuring the noise with a microphone or the like and analyzing the frequency with an analyzer or the like, appropriate sound insulation can be achieved by adjusting the distance between the two soundproof units according to the analysis result.

As described above, the present invention is a new soundproof structure which is a small and lightweight low-frequency soundproof material and which can easily change the frequency characteristics.

Figure 2:
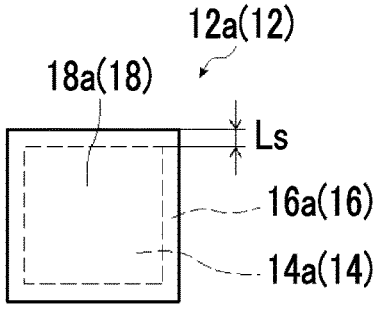
FIG. 2 is a diagram of the soundproof structure shown in FIG. 1 taken along the line II-II.
Figure 3:
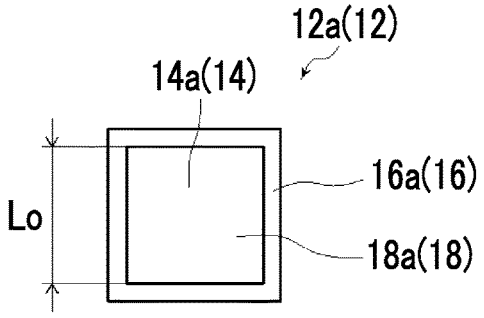
FIG. 3 is a diagram of the soundproof structure shown in FIG. 1 taken along the line III-III.

FIG. 1 is a cross-sectional view schematically showing an example of a soundproof structure according to an embodiment of the present invention, FIG. 2 is a left side view of the soundproof structure shown in FIG. 1, and FIG. 3 is a diagram taken along the line III-III of the soundproof structure shown in FIG. 1.

A soundproof structure 10 according to the embodiment of the present invention shown in FIGS. 1, 2, and 3 has two soundproof units 12 (12*a*, 12*b*).

In the example shown in FIGS. 1 to 3, each soundproof unit 12 (12*a*, 12*b*) has the same configuration, has a square hollow inner space 13 (13*a*, 13*b*), and has a square cylindrical (for example, square tubular) outer shell 16 (16*a*, 16*b*) comprising a square opening portion 14 (14*a*, 14*b*) that is provided on a surface serving as one end portion and is open to the outside. The outer shell 16 (16*a*, 16*b*) comprises a square lid member 18 (18*a*, 18*b*) that is provided on a surface, which is the other end portion facing the opening portion 14 (14*a*, 14*b*) on the surface serving as the one end portion, and separates the inner space 13 (13*a*, 13*b*) and the outer space (for example, acoustically separates the inner space 13 (13*a*, 13*b*) and the outer space, preferably, airtightly blocks the inner space 13 (13*a*, 13*b*) from the outer space).

In the soundproof structure 10 of the illustrated example, the two soundproof units 12*a* and 12*b* are disposed close to each other by aligning the axis directions (for example, central axis directions) of the cylindrical shapes of the outer shells 16*a* and 16*b* so that the opening portion 14*a* of the outer shell 16*a* and the opening portion 14*b* of the outer shell 16*b* face each other.

Here, between two soundproof units 12*a* and 12*b* disposed close to each other, specifically, between the opening portions (opening ends) 14*a* and 14*b* of the outer shells 16*a* and 16*b* of the two soundproof units 12*a* and 12*b*, a rectangular parallelepiped slit 20 communicating with the inner spaces 13*a* and 13*b* is formed.

In the present invention, the fact that the two soundproof units 12*a* and 12*b* are close to each other means that the opening portions (hereinafter, also referred to as opening ends) 14*a* and 14*b*, which are respective one end portions of the two outer shells 16*a* and 16*b* are close to each other. That is, the fact that the two soundproof units 12*a* and 12*b* are close to each other means that the average distance between the opening portions 14*a* and 14*b* of the two outer shells 16*a* and 16*b* is as short as less than 20 mm but the two soundproof units 12*a* and 12*b* are spaced apart from each other.

Incidentally, in the present invention, the distance between the opening ends of the two outer shells 16*a* and 16*b* (for example, the distance between the two opening portions 14*a* and 14*b*) refers to a distance or an interval between the two opening ends (that is, the opening portions 14*a* and 14*b*). In the present invention, therefore, it is preferable that positions of both opening end surfaces of the two opening ends 14*a* and 14*b*, that is, positions of the opening end surface of the opening end 14*a* and the opening end surface of the opening end 14*b*, are made to face each other so as to match in the axis direction by aligning or matching the axis directions (for example, central axis directions) of the cylindrical shapes of the outer shells 16*a* and 16*b*. However, the present invention is not limited thereto, and both the opening end surfaces of the two opening ends 14*a* and 14*b* may not necessarily face each other as long as the resonance frequency of the air column resonance of the two outer shells 16*a* and 16*b* can be shifted to the low frequency side by bringing the two outer shells 16*a* and 16*b* close to each other. For example, one of the two opening ends 14*a* and 14*b* may be translated (shifted in parallel) or rotated with respect to the other one as in a soundproof structure 10*d* shown in FIG. 27, or may be shifted and rotated with respect to the other one as in a soundproof structure 10*e* shown in FIG. 29. In such a case, the distance between both opening end surfaces is expressed by the average distance between the opening end surfaces.

In this case, in a case where the two outer shells 16*a* and 16*b* face each other in a state in which there is no overlap between both the opening ends 14*a* and 14*b*, frequency shift disappears compared with the case of a single body. That is, translation and/or rotation is allowed, but it is necessary that the two outer shells 16*a* and 16*b* face each other in a state in which there is an overlap between both the opening end surfaces. The state in which there is an overlap between both the opening end surfaces means that, in a case where a projection view obtained by projecting an opening end portion of one of the soundproof units in a direction perpendicular to the opening end surface from the opening end of the one soundproof unit is shown on the opening end of the other soundproof unit, there is a portion overlapping the other opening end.

In the present invention, the "distance" between the opening end surfaces of the two soundproof units is defined as follows.

Figure 29:
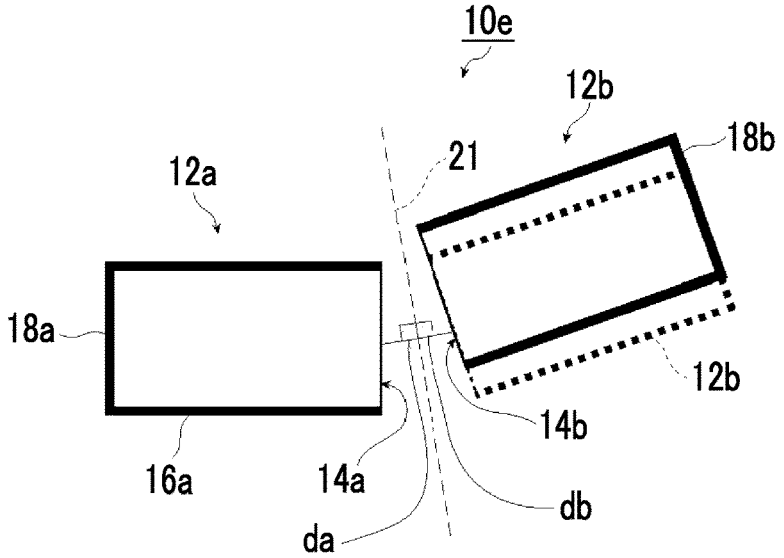
FIG. 29 is a schematic cross-sectional view of an example of a soundproof structure according to another embodiment of the present invention.

First, as shown in FIG. 29, even in the soundproof structure (10*e*) in which the opening ends (14*a* and 14*b*) of the two soundproof units (12*a* and 12*b*) are shifted (translated) and rotated, one soundproof unit (for example, 12*b*) is translated to a position indicated by a dotted line so that the two soundproof units (12*a* and 12*b*) are disposed so as to face each other. Then, on this basis, a mirror image plane (21) with respect to the opening end surfaces of the opening ends (14*a* and 14*b*) of the two soundproof units (12*a* and 12*b*) completely facing each other is determined. Here, in a case where the "distance" is defined as the lengths da and db of perpendiculars from the two opening end surfaces in the case of drawing a line perpendicular to the mirror image plane 21 from each opening end surface, the average value of the distance (the sum of the lengths of the perpendiculars da+db) between the two opening ends on the entire opening end surface is defined as "average distance between opening ends of two soundproof units".

Figure 27:
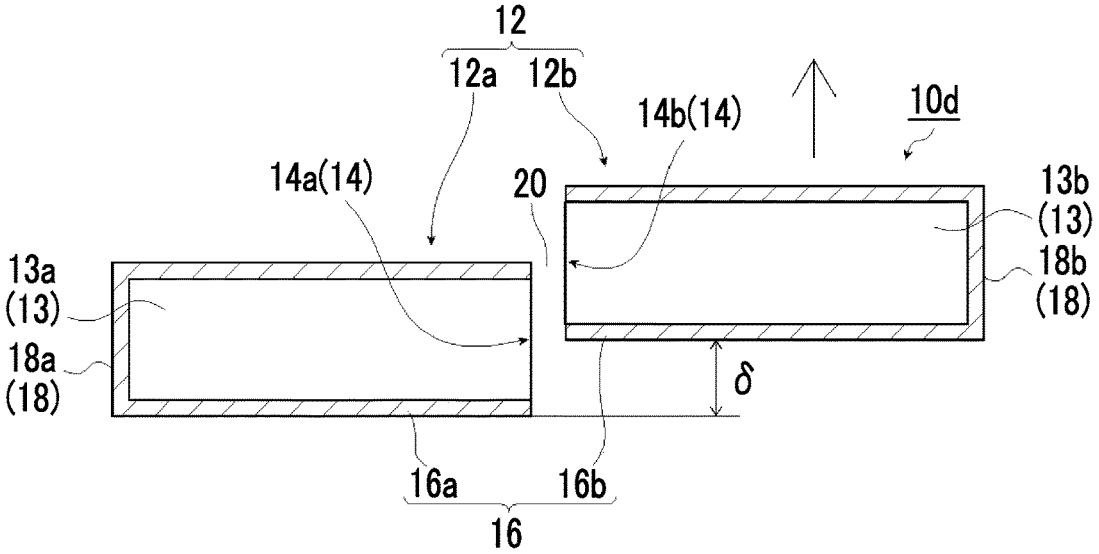
FIG. 27 is a schematic cross-sectional view of a soundproof structure of Example 12 of the present invention.

In the case of the soundproof structure 10*d* in which there is a positional shift (translation) as shown in FIG. 27, one soundproof unit (12*a* or 12*b*) may be translated to make the opening end surfaces of the two soundproof units (12*a* and 12*b*) completely face each other, and then the above-described definition may be applied. In the case of simple rotation, the above-described definition may be applied without performing a translational operation.

As a result of intensive studies on sound insulation in a low frequency region that has been difficult by the inventors of the present invention, it has been found that the sound absorption frequency is shifted to the low frequency side by bringing the opening ends of the air column resonance tubes, such as cylindrical outer shells, which are not known hitherto close to each other, that is, the effect of the low frequency shift occurs in a case where the average distance between the opening ends is less than 20 mm and the effect becomes noticeable as the average distance between the opening ends decreases. Conceivably, the reason why these findings were not made is that the wavelength of sound is extremely large compared with the gap size that a distance between the opening ends. In addition, in a case where the air column resonance tube is used for sound absorption, it is common that the opening end is mainly disposed relative to the sound or at least as shown in JP3831263B, the opening end is disposed so as to face a surface through which the sound passes (such as a structure placed in a horizontal direction with respect to the wall in a duct). Since a structure that absorbs sound based on the arrangement, in which the opening ends are brought close to each other so that the opening end surface does not directly face the surface through which the sound passes, is not common, it is thought that it was not easy to imagine the findings.

In contrast, the soundproof structure 10 according to the embodiment of the present invention is preferably a structure in which the inner space 13 (13*a* and 13*b*) and the outer space are connected to each other through the opening portion 14 (14*a* and 14*b*) so as to be able to transmit a gas propagating sound, and more preferably a structure that causes an air column resonance phenomenon with respect to the sound flowing through the opening portion 14 (14*a* and 14*b*).

In the present invention, it is necessary to limit the average distance D between the opening ends of the two opening ends 14*a* and 14*b* shown in FIG. 1 to less than 20 mm. The reason is that, in a case where the average distance D between the two opening ends 14*a* and 14*b* is 20 mm or more, the effect of low frequency shift of the sound absorption frequency cannot be seen.

In the present invention, the average distance D between the opening ends 14*a* and 14*b* is preferably 15 mm or less, more preferably 10 mm or less, even more preferably 5 mm or less, and most preferably 2 mm or less.

Incidentally, in the soundproof structure 10 according to the embodiment of the present invention, in a case where the average distance D between the opening ends 14*a* and 14*b* is reduced by increasing the size Ls of the frame (rectangular tube body) around each of the opening portions 14*a* and 14*b* of the two soundproof units 12*a* and 12*b*, both the absorption peak due to air column resonance of the present invention and the absorption peak due to slit Helmholtz resonance caused by the generation of frictional heat due to thermoacoustic effect in a slit portion interposed between the frames (rectangular tube bodies) can appear together.

In the following description, in a case where components of the soundproof structure 10, such as the two soundproof units 12*a* and 12*b*, the inner spaces 13*a* and 13*b*, the opening portions (opening ends) 14*a* and 14*b*, the outer shells 16*a* and 16*b*, and the lid members 18*a* and 18*b*, have the same configuration and it is not necessary to distinguish therebetween, the two soundproof units 12*a* and 12*b*, the inner spaces 13*a* and 13*b*, the opening portions (opening ends) 14*a* and 14*b*, the outer shells 16*a* and 16*b*, and the lid members 18*a* and 18*b* will be collectively described without distinction as the soundproof unit 12, the inner space 13, the opening portion (opening end) 14, the outer shell 16, and the lid member 18, respectively.

Figure 4:
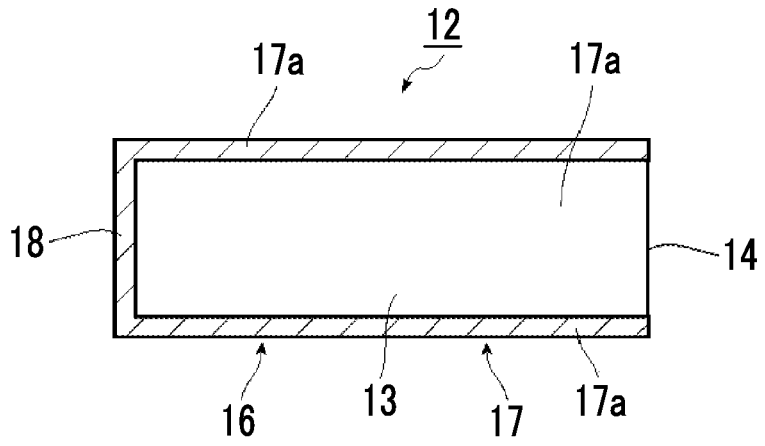
FIG. 4 is a schematic cross-sectional view of an example of a soundproof unit used in the soundproof structure shown in FIG. 1.

FIG. 4 is a schematic cross-sectional view of an example of a soundproof unit used in the soundproof structure shown in FIG. 1. The left side view of the soundproof unit shown in FIG. 4 is the same as the left side view of the soundproof structure shown in FIG. 3, and the right side view of the soundproof unit shown in FIG. 4 is the same as the view of the soundproof structure shown in FIG. 2 taken along the line III-III. Therefore, illustration thereof will be omitted.

As shown in FIG. 4, the soundproof unit 12 has the outer shell 16 having the hollow inner space 13 inside. The outer shell 16 comprises: the rectangular tube body 17 having a square cross section that is formed by a cylindrical frame, for example, four side plate-shaped members 17*a* in FIGS. 2 to 4; the opening portion 14 whose surface of one end portion in the axis direction of the rectangular tube body 17 that is a cylindrical frame is opened to the outer space and which serves as a boundary between the inner space 13 of the outer shell 16 and the outer space; and the lid member 18 that is provided on the surface of the other end portion of the outer shell 16 in the axis direction of the cylindrical rectangular tube body (frame) 17, blocks the inner space 13 of the outer shell 16 from the outer space, and closes the other end portion of the rectangular tube body (frame) 17.

The soundproof unit 12 used in the present invention causes absorption and/or reflection of sound by resonance, so-called air column resonance of a one side closed tube formed by the rectangular tube body (frame) 17, the opening portion 14, and the lid member 18 of the outer shell 16. However, the outer shell 16 is a frame structure in which one side, on which air column resonance occurs, is closed, for example, a rectangular tube body structure, and has a feature that the standing wave of sound is formed in the entire tube and the sound wave is absorbed in the entire tube. Therefore, it is preferable that the outer shell 16 is a resonance tube structure in which not only the lid member 18 but also the four side plate-shaped members 17*a* are closed.

The soundproof unit 12 used in the present invention is not particularly limited as long as it is possible to cause absorption and/or reflection of sound by the air column resonance of the outer shell 16, and any soundproof unit may be used. That is, the soundproof unit 12 may be any soundproof unit as long as air column resonance can occur in the inner space 13 formed by the outer shell 16 having the rectangular tube body 17, the opening end 14, and the lid member 18 on the rear surface, preferably, in the inner space 13 that is a closed space.

As described above, the air column resonance in the soundproof unit 12 according to the embodiment of the present invention is the simplest resonance phenomenon even though the size of the soundproof unit is increased, compared with the case of using film vibration by a general vibration film, Helmholtz resonance by a through-hole, or slit Helmholtz resonance disclosed in JP3893053B. Therefore, since the soundproof unit 12 according to the embodiment of the present invention is very strong and has high robustness, the vibration of the structure is small. In such a soundproof unit 12, the peak of the frequency of the air column resonance with respect to the change in the proximity distance between the two opening ends 14 in a case where the two soundproof units 12 are disposed close to each other to form the soundproof structure 10, that is, the shift amount of the soundproofing frequency is large, various frequencies can be reliably and easily controlled with the proximity distance described above.

Therefore, in the soundproof unit 12, as a resonance phenomenon, it is preferable to cause air column resonance of an approximately closed tube with respect to sound by the inner space 13 and the opening portion 14.

Figure 30A:
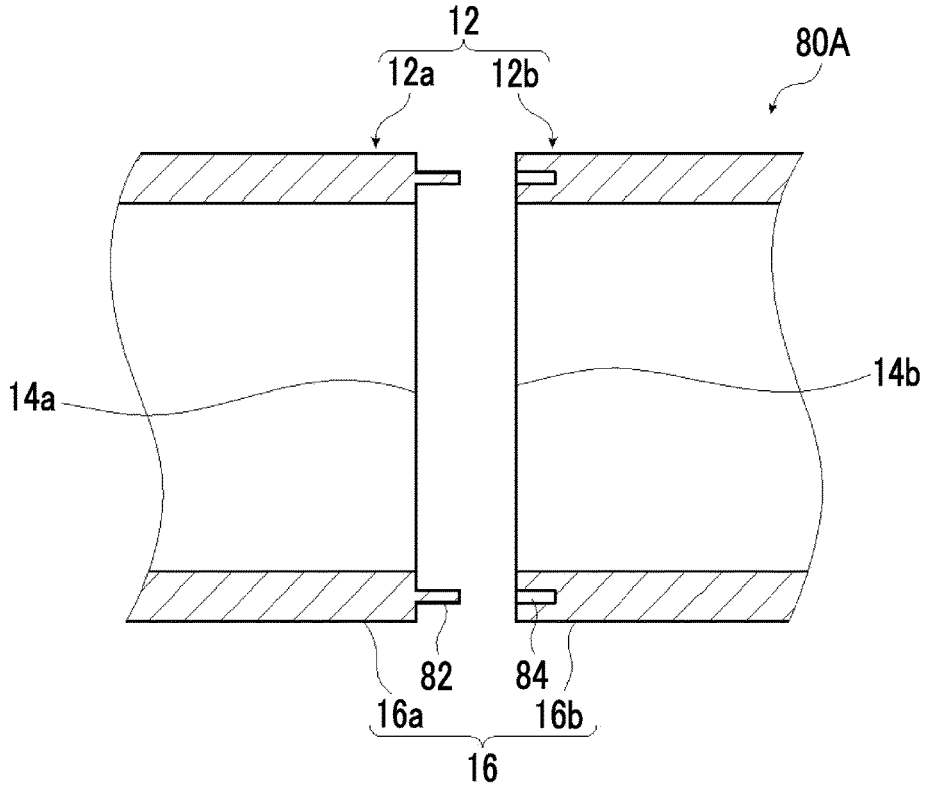
FIG. 30A is a schematic cross-sectional view of an example of a soundproof structure according to another embodiment of the present invention.

The method of arranging the two soundproof units 12 used in the present invention is not limited. For example, the two soundproof units 12*a* and 12*b* can be disposed close to each other by aligning the central axis directions of the cylindrical shapes of the outer shells 16*a* and 16*b* such that the opening portion 14*a* of the outer shell 16*a* and the opening portion 14*b* of the outer shell 16*b* face each other. As in a soundproof structure 80A shown in FIG. 30A, a pin-shaped protruding portion 82 is provided at the end portion of the outer shell 16*a* in the soundproof unit 12*a* and a recessed portion 84 into which the protruding portion 82 is inserted is provided at the end portion of the outer shell 16*b* in the soundproof unit 12*b* and the length of the protruding portion 82 is made to be larger than the length of the groove of the recessed portion 84, so that the distance between the opening ends of the two soundproof units 12*a* and 12*b* can be maintained at a predetermined length in a case where the protruding portion 82 is inserted into the recessed portion 84.

Figure 30B:
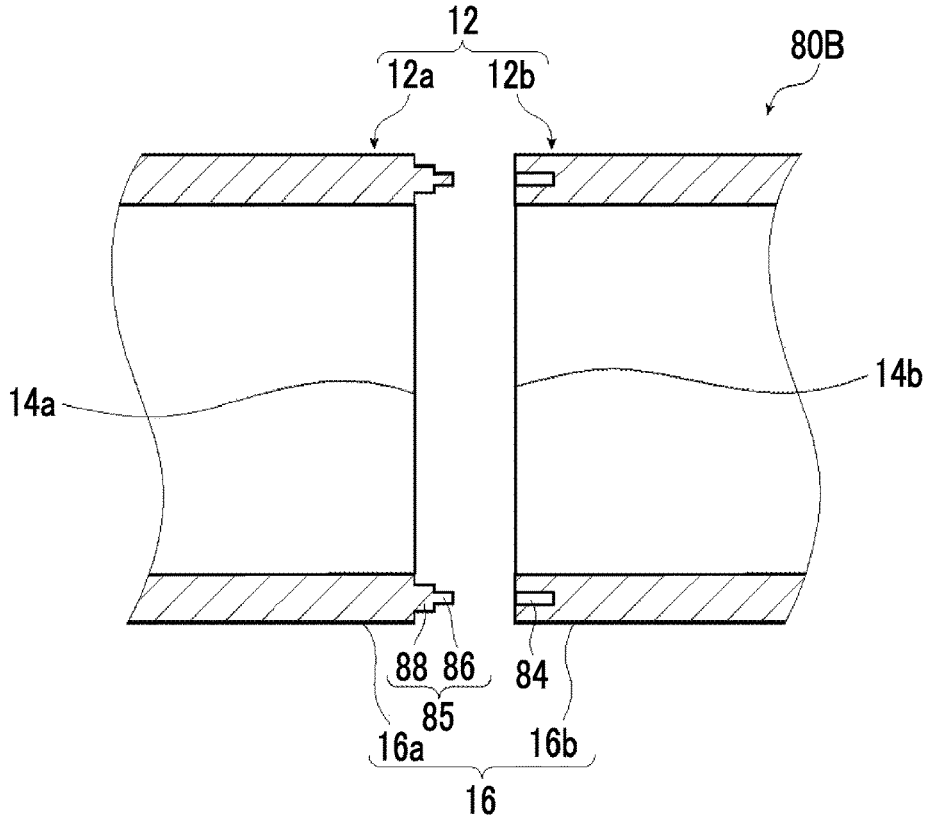
FIG. 30B is a schematic cross-sectional view of an example of a soundproof structure according to another embodiment of the present invention.

In addition, as in a soundproof structure 80B shown in FIG. 30B, a protruding portion 85 includes a pin-shaped narrow portion 86, which has a size that can fit into a recessed portion 84, and a thick portion 88, which has a diameter larger than the diameter of the recessed portion 84, and the narrow portion 86 of the protruding portion 85 fits into the recessed portion 84 and the thick portion 88 of the protruding portion 85 is engaged with the opening portion of the recessed portion 84, so that the distance between the opening ends of the two soundproof units 12*a* and 12*b* can be maintained at a predetermined length.

As shown in FIG. 4 and FIGS. 2 and 3, since the outer shell 16 of the soundproof unit 12 has a quadrangular (square) cross section, the outer shell 16 has a structure in which five surfaces of four surfaces of the side surfaces and one surface of the lid member 18 are closed and only one surface of the opening portion 14 is opened.

Figure 5:
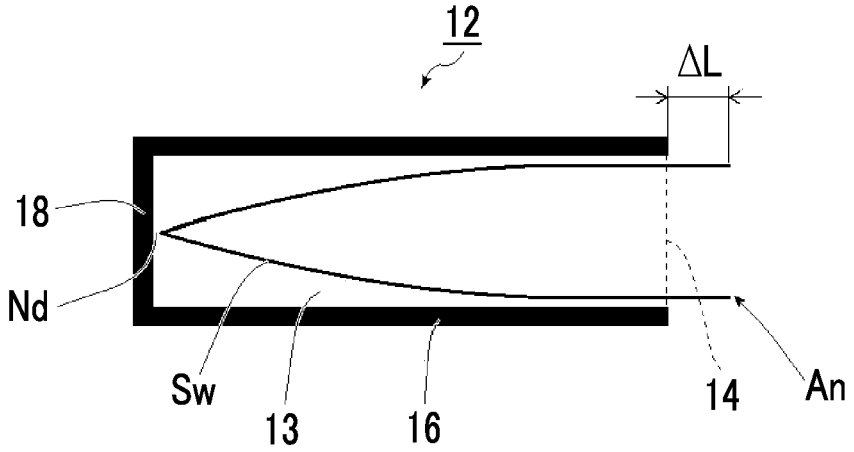
FIG. 5 is a schematic diagram of an example of a standing wave in the soundproof unit shown in FIG. 4.

As shown in FIG. 5, the outer shell 16 having such a structure has a resonance of $\lambda/4$ having the closed lid member 18 as a node Nd of a standing wave Sw of the sound field and a position, which is apart by an opening end correction distance AL from the opening end 14 to the outside, as a belly An, so-called air column resonance, in the inner space 13, and causes reflection and absorption at the frequency. That is, as shown in FIG. 5, the belly An of the standing wave Sw of the sound field protrudes to the outside of the opening end 14 of the outer shell 16 by the opening end correction distance $\Delta L$. Therefore, the soundproofing performance can be obtained even outside the outer shell 16. The opening end correction distance $\Delta L$ is given by approximately 0.61×tube radius in the case of a cylindrical tube body. For example, in the case of the outer shell 16 that is a square tube body shown in FIGS. 1 to 4, an approximate radius at the time of approximating to a circular tube having an opening area corresponding to the opening area of the square opening end 14 may be approximately obtained as a tube radius.

The outer shell 16 has the hollow inner space 13 inside the rectangular tube body 17 formed so as to annularly surround four side surfaces with the side plate-shaped member 17*a* having a thickness, and forms the rectangular tube body 17 that is a one side closed structure comprising the opening portion 14, which is for opening the inner space 13 to the outside on one side, and the lid member 18 that blocks the inner space 13 from the outer space on the other side. The air column resonance phenomenon occurs in the inner space 13 of the outer shell 16. Therefore, any members may be used as the side plate-shaped member 17*a* of the rectangular tube body 17 and the lid member 18 of the outer shell 16 as long as the members separate the inner space 13 from the outer space. For example, a member that acoustically separates both the members from each other is preferable, and a member that completely blocks both the members or airtightly blocks both the members is more preferable. Such a member is preferably, for example, a dense member, a member having high stiffness, or a member having both high mass per unit area and high stiffness.

Preferably, in the outer shell 16, it is preferable to block the inner space 13 from the outer space except for two surfaces (surfaces onto which the opening portion 14 and the lid member 18 are attached) serving as both end portions of the outer shell 16 in the axis direction of the cylindrical shape, and it is more preferable to airtightly or completely block the inner space 13 from the outer space except for the two surfaces. That is, in the rectangular tube body 17, it is preferable to block the inner space 13 from the outer space, and it is more preferable to airtightly or completely block the inner space 13 from the outer space.

The outer shell 16 is a tubular structure having a square cross section in which only one side (that is, one surface on one side) is opened by the opening portion 14 and the remaining five surfaces are closed (specifically, a rectangular tubular structure having a square cross section in which one surface on the other side is closed by the lid member 18 and the four side surfaces are closed by the rectangular tube body 17 formed by the side plate-shaped members 17*a*). However, the present invention is not limited thereto. For example, in the outer shell 16, one or more openings, such as through-holes, may be provided in the lid member 18, between the lid member 18 and the rectangular tube body 17, and in at least one of the four side plate-shaped members 17*a* of the rectangular tube body 17 as long as the openings do not interfere with air column resonance.

Figure 6:
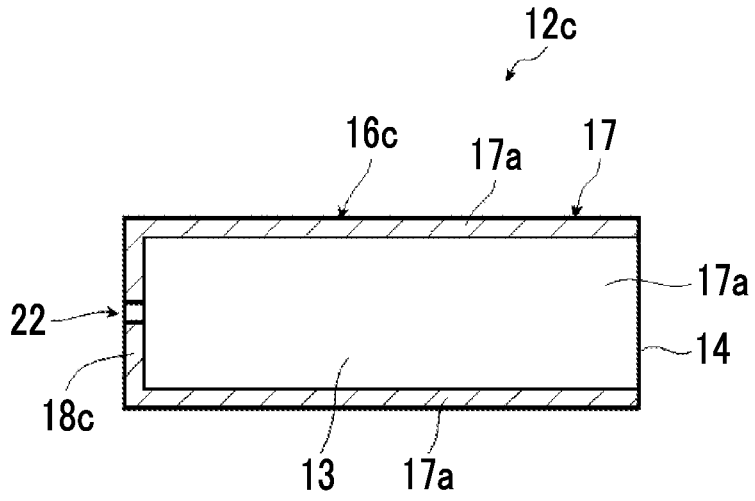
FIG. 6 is a schematic cross-sectional view of another example of the soundproof unit used in the soundproof structure of the present invention.

For example, as in a soundproof unit 12*c* shown in FIG. 6, an opening 22 may be provided at the center of a lid member 18*c* of an outer shell 16*c*, or a plurality of through-holes may be provided although not shown.

Figure 7:
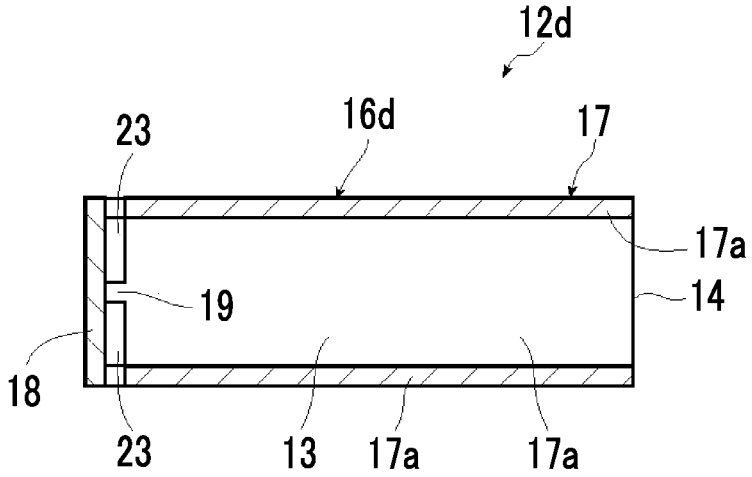
FIG. 7 is a schematic cross-sectional view of another example of the soundproof unit used in the soundproof structure of the present invention.

Alternatively, as in a soundproof unit 12*d* shown in FIG. 7, an opening 23 may be provided between the rectangular tube body 17 and the lid member 18*c* of an outer shell 16*d*. In the outer shell 16*d* shown in FIG. 7, a connection member 19 is attached between the lid member 18*c* and each side plate-shaped member 17*a* of the rectangular tube body 17, the lid member 18*c* is supported on the rectangular tube body 17 by the connection member 19, and the opening 23 divided into a plurality of parts, for example, four parts, is provided. However, the present invention is not limited thereto. In the soundproof unit 12*d*, for example, members (not shown) for supporting the lid member 18*c* and the rectangular tube body 17 may be provided in the soundproof structure, and an opening that is continuous between both the lid member 18*c* and the rectangular tube body 17 so as to make both the lid member 18*c* and the rectangular tube body 17 spaced apart from each other may be provided.

Although not shown, one or more through-holes may be provided in at least one of the four side plate-shaped members 17*a* of the rectangular tube body 17. However, from the viewpoint of absorption of sound by the entire inner surface of the tube in air column resonance, absorption is reduced in a case where there are through-holes. In particular, it is preferable that no through-hole is provided in the four side plate-shaped members 17*a* of the rectangular tube body 17.

As described above, openings such as through-holes provided in the four side plate-shaped members 17*a* of the rectangular tube body 17 and the lid member 18 and between the four side plate-shaped members 17*a* of the rectangular tube body 17 and the lid member 18 (for example, the openings 22 and of 23 of the soundproof units 12*c* and 12*d* shown in FIGS. 6 and 7) are based on the premise that the openings do not interfere with air column resonance. Therefore, these openings are openings having relatively small sizes, and need to be smaller than the size of the opening portion 14 of each of the soundproof units 12*c* and 12*d*. That is, each of the opening portions 14 (14*a* and 14*b*) of the soundproof units 12, 12*a*, 12*b*, 12*c*, and 12*d* is a first opening portion according to the embodiment of the present invention that is an opening portion having a maximum size provided in the outer shell 16 (16*a*, 16*b*, 16*c*, and 16*d*).

On the other hand, each of the openings 22 and 23 of the soundproof units 12*c* and 12*d* shown in FIGS. 6 and 7 is a second opening portion according to the embodiment of the present invention that has a smaller size than the first opening portion according to the embodiment of the present invention, such as the opening portion 14 (14*a* and 14*b*).

As shown in FIGS. 1 and 4 to 7, in a case where the cross-sectional shape perpendicular to the central axis direction of the cylindrical shape is the same along the axis direction (that is, in a case where the two side plate-shaped members 17*a* of the rectangular tube body 17 corresponding to or facing each other are parallel), the shape of the outer shell 16 (16*a*, 16*b*, 16*c*, and 16*d*) is characterized as a tubular body having an end surface shape or a cross-sectional shape perpendicular to the central axis direction of the cylindrical shape. However, the shape of the outer shell 16 (16*a*, 16*b*, 16*c*, and 16*d*) can be said to be the shape of the inner space 13 formed by the outer shell 16, or can be said to be a tubular body having the shape of the lid member 18 or the opening shape of the opening portion 14.

The shape of the opening portion 14 is the cross-sectional shape or the end surface shape of the outer shell 16 (that is, the shape of the opening portion 14 is a square in the examples shown in FIGS. 2 and 3), but is not particularly limited in the present invention. For example, the shape of the opening portion 14 may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. The end portion on one side of the inner space 13 of the outer shell 16 is not closed but is opened to the outside as the opening portion 14 having a shape equal to the opening shape of the cross-sectional shape of the outer shell 16.

The soundproof unit 12 (12*a*, 12*b*, 12*c*, and 12*d*) may have a porous sound absorbing body arranged in contact with the inner space 13 (13*a*, 13*b*) or the outside of the soundproof unit 12.

Here, the porous sound absorbing body has a minute air gap portion formed by a material and contains air in the air gap portion, and has a function of absorbing sound since viscous friction of the air in the vicinity of the material occurs in a case where sound passes through the minute air gap portion.

As the porous sound absorbing body, for example, known sound absorbing materials, such as (1) materials containing a small amount of air and foamed materials, such as foamed urethane, flexible urethane foam, wood, ceramic particle sintered material, and phenol foam, (2) gypsum board, (3) fibers, such as glass wool, rock wool, microfiber (such as thinslate manufactured by 3M), floor mat, carpet, meltblown nonwoven fabric, metal nonwoven fabric, polyester nonwoven fabric, metal wool, felt, insulation board, and glass nonwoven fabric, and nonwoven fabric materials, (4) wood cement board, and (5) nanofiber-based materials such as silica nanofiber, can be appropriately used.

The shape of the outer shell 16 may have a tubular body portion whose cross-sectional shape is the same in a partial region in the central axis direction, without being limited to the case where the cross-sectional shape perpendicular to the central axis direction of the cylindrical shape is the same over the entire region in the axis direction as shown in FIGS. 1 and 4 to 7.

Figure 8:
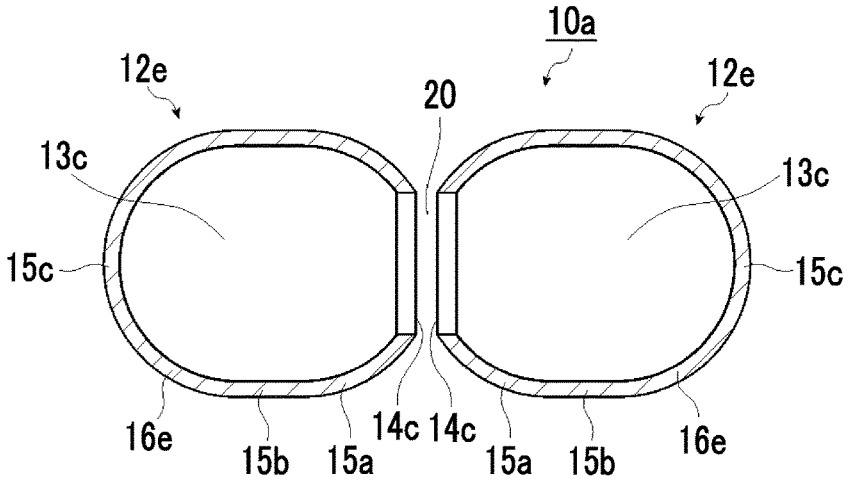
FIG. 8 is a schematic cross-sectional view of an example of a soundproof structure according to another embodiment of the present invention.

For example, like an outer shell 16*e* forming each of two soundproof units 12*e* of a soundproof structure 10*a* shown in FIG. 8, an outer shell may comprise: a base end portion 15*a* that is a part of a spherical shell cut by a first plane passing through the center and a second plane, which passes through a middle of a radius perpendicular to the first plane and is parallel to the first plane, and has a circular opening portion 14*c* formed by an end surface cut by the second plane; a circular tube portion 15*b* having an end surface with the same shape that is connected to the end surface of the hemispherical shell cut by the first plane of the base end portion 15*a*; and a distal end portion 15*c* formed by a hemispherical shell having an end surface with the same shape that is connected to the end surface of the circular tube portion 15*b*.

As long as the outer shell has a partially cylindrical portion like the circular tube portion 15*b* as shown in FIG. 8, the distal end portion 15*c* facing the opening portion 14 blocks the inner space 13*c* from the outer space like the lid member 18. However, the distal end portion 15*c* does not need to have a two-dimensional shape unlike the flat plate-shaped lid member 18 and may have a three-dimensional shape, such as a spherical shell shape, and the base end portion 15*a* having the opening portion 14*c* may not have a cylindrical shape or a tubular shape. The inner space 13*c* of the outer shell 16*e* is formed by the space inside the base end portion 15*a*, the circular tube portion 15*b*, and the distal end portion 15*c*.

Figure 8A:
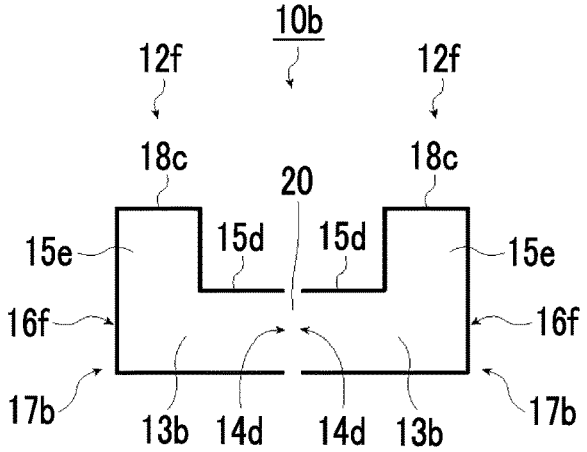
FIG. 8A is a schematic cross-sectional view of an example of a soundproof structure according to another embodiment of the present invention.

Alternatively, like an outer shell 16*f* of a soundproof unit 12*f* of a soundproof structure 10*b* shown in FIG. 8A, an outer shell may comprise: a bent tube body 17*b* configured to include a straight tube shaped base end portion 15*d* having an opening portion 14*d* and a straight tube shaped distal end portion 15*e* bent vertically from the base end portion 15*d*; and a lid member 18*c* that is attached to the distal end opening of the distal end portion 15*e* of the bent tube body 17*b* and blocks an inner space 13*d* of the bent tube body 17*b* from the outer space.

In the soundproof structure 10*b* shown in FIG. 8A, the opening portions 14*d* of the base end portions 15*d* of the outer shells 16*f* of the two soundproof units 12*f* are disposed so as to face each other in a state in which the distal end portions 15*e* of the two outer shells 16*f* face the same side with respect to the two base end portions 15*d* arranged in the shape of a straight line. However, the present invention is not limited thereto, and the two opening portions 14*d* may be disposed so as to face each other in a state in which the distal end portions 15*e* of the two outer shells 16*f* face different sides.

In the shape of the outer shell 16 (16*a*, 16*b*, 16*c*, and 16*d*) of the soundproof unit 12 (12*a*, 12*b*, 12*c*, and 12*d*), as shown in FIGS. 1 and 4 to 7, the length (tube length) of the rectangular tube body 17 is larger than the distance between the side plate-shaped members 17*a* facing each other of the rectangular tube body 17 (aperture of the opening portion 14), and the aspect ratio expressed by tube length/aperture is larger than 1. However, the present invention is not limited thereto.

Figure 8B:
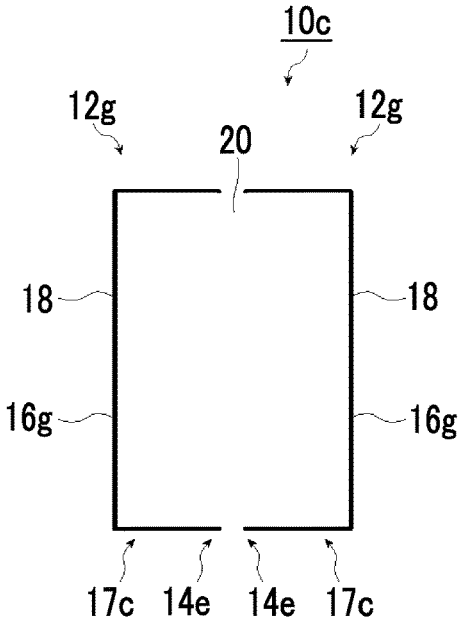
FIG. 8B is a schematic cross-sectional view of an example of a soundproof structure according to another embodiment of the present invention.

As in an outer shell 16*g* of a soundproof unit 12*g* of a soundproof structure 10*c* shown in FIG. 8B, the length (tube length) of a rectangular tube body 17*c* may be shorter than the distance between the side surfaces facing each other of the rectangular tube body 17*c* (aperture of an opening portion 14*e*), and the aspect ratio expressed by tube length/aperture may be 1 or less.

Hereinafter, the examples shown in FIGS. 1 to 4 will be described as representative examples.

In the case of a regular polygon such as a square shown in FIGS. 2 and 3 or a circle, the size Lo of the opening portion 14 of the outer shell 16 can be defined as a distance between opposite sides passing through the center or as a circle equivalent diameter. In the case of a polygon, an ellipse, or an irregular shape, the size Lo of the opening portion 14 of the outer shell 16 can be defined as a circle equivalent diameter. In the present invention, the circle equivalent diameter and the radius are a diameter and a radius at the time of conversion into circles having the same area.

In the examples shown in FIGS. 1 to 7, the outer size of the cross-sectional shape of the outer shell 16 and the size of the lid member 18 can be calculated as (Lo+2*Ls), which is obtained by adding the thickness Ls of the two side plate-shaped members 17*a* facing each other of the rectangular tube body 17 to the size Lo of the opening portion 14 of the outer shell 16.

As shown in FIGS. 1 to 3, the thickness of the outer shell 16 can be expressed by the thickness Ls of the side plate-shaped member 17*a* of the rectangular tube body 17 of the outer shell 16 or the thickness Lc of the lid member 18 of the outer shell 16. Here, the thickness Ls of the side plate-shaped member 17*a* and the thickness Lc of the lid member 18 may be the same or different. However, from the viewpoint of handling, it is preferable that the thickness Ls of the side plate-shaped member 17*a* and the thickness Lc of the lid member 18 are the same.

As the size of the outer shell 16, the length of the outer shell 16 in the central axis direction of the cylindrical shape depending on the wavelength of the standing wave of air column resonance occurring in the outer shell 16 is important. Therefore, the size of the outer shell 16 can be defined as the length Lt of the side plate-shaped member 17*a* that is a constituent member of the outer shell 16 interposed between the opening end 14 and the lid member 18. That is, the size of the outer shell 16 can be defined as the length Lt of the rectangular tube body 17, and can also be defined as the size of the outer shell 16 in the axis direction of the inner space 13.

The size Lt of the outer shell 16, the thickness (Ls, Lc), and the size Lo of the opening portion 14 are not particularly limited, and may be set according to a soundproofing target to which the soundproof structures 10 and 10*a* (hereinafter, represented by the soundproof structure 10) according to the embodiment of the present invention are applied for soundproofing, for example, a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a PC, a vacuum cleaner, and an air purifier.

The soundproof structure 10 itself can also be used like a partition in order to shield sound from a plurality of noise sources. Also in this case, the size of the outer shell 16 can be selected from the wavelength or the frequency of the target noise.

In addition, in order to prevent sound leakage due to diffraction at the absorption peak of the soundproof unit 12, it is preferable that the size Lo of the opening portion 14 of the outer shell 16 is equal to or less than the wavelength size corresponding to the absorption peak frequency.

For example, the size Lo of the opening portion 14 of the outer shell 16 is preferably 0.5 mm to 200 mm, more preferably 1 mm to 100 mm, and most preferably 2 mm to 30 mm.

For example, in a case where the size Lo of the opening portion 14 is 0.5 mm to 50 mm, the thickness of the outer shell 16, in particular, the thickness Ls of the side plate-shaped member 17*a* of the rectangular tube body 17 is preferably 0.5 mm to 20 mm, more preferably 0.7 mm to 10 mm, and most preferably 1 mm to 5 mm.

In addition, in a case where the size Lo of the opening portion 14 exceeds 50 mm and 200 mm or less, the thickness of the outer shell 16, in particular, the thickness Ls of the side plate-shaped member 17*a* of the rectangular tube body 17 is preferably 1 mm to 100 mm, more preferably 3 mm to 50 mm, and most preferably 5 mm to 20 mm.

Although the thickness Lc of the lid member 18 of the outer shell 16 is not particularly limited, it is preferable to set the thickness Lc to be the same thickness as the thickness Ls of the side plate-shaped member 17*a* of the rectangular tube body 17 described above.

It is preferable to set the size Lt of the outer shell 16 according to the wavelength of the standing wave of air column resonance occurring in the outer shell 16. It is most preferable to set the length obtained by subtracting the opening end correction distance from the length of ¼ (λ/4) of the wavelength of the sound to be soundproofed since it is possible to generate the strongest air column resonance. However, the present invention is not limited thereto, and any length may be set as the size Lt of the outer shell 16 as long as the air column resonance can be caused. From the viewpoint of ease of use, the size Lt of the outer shell 16 may be 0.5 mm to 200 mm, more preferably 0.7 mm to 100 mm, and most preferably 1 mm to 50 mm.

The material of the outer shell 16, for example, the side plate-shaped member 17*a* of the rectangular tube body 17 and the lid member 18 is not particularly limited as long as the material has a suitable strength in the case of being applied to the above soundproofing target and is resistant to the soundproof environment of the soundproofing target, and can be selected according to the soundproofing target and the soundproof environment. Examples of the material of the outer shell 16 include a metal material, a resin material, a reinforced plastic material, a rubber material, and a carbon fiber. Examples of the metal material include aluminum, titanium, magnesium, tungsten, iron, steel, chromium, chromium molybdenum, nichrome molybdenum, and alloys thereof. Examples of the resin material include acrylic resin, methyl polymethacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose. Examples of the reinforced plastic material include carbon fiber reinforced plastics (CFRP) and glass fiber reinforced plastics (GFRP). As the rubber material, silicone rubber, synthetic rubber, natural rubber, or structure obtained by adding a filler or the like can be mentioned.

A plurality of materials of the outer shell 16 may be used in combination.

The material of the outer shell 16 may be the same or different. That is, the material of the side plate-shaped member 17*a* of the rectangular tube body 17 and the material of the lid member 18 of the outer shell 16 may be the same or different.

In the present invention, however, it is preferable that the outer shell 16 of the soundproof unit 12 (that is, the side plate-shaped member 17*a* of the rectangular tube body 17 and the lid member 18) is formed of the same material, and it is preferable that the outer shell 16 of the soundproof unit 12 (that is, the side plate-shaped member 17*a* of the rectangular tube body 17 and the lid member 18) is formed of a material that does not allow sound as a gas propagating sound to pass therethrough.

In the present invention, in a case where the material of the rectangular tube body 17 of the outer shell 16 and the material of the lid member 18 are the same, the rectangular tube body 17 of the outer shell 16 and the lid member 18 may be integrally formed. However, from the viewpoint of manufacturability, it is preferable that the rectangular tube body 17 of the outer shell 16 and the lid member 18 are separately formed. In a case where the material of the rectangular tube body 17 of the outer shell 16 and the material of the lid member 18 are different, it is undoubtedly preferable that the rectangular tube body 17 of the outer shell 16 and the lid member 18 are separately formed.

Here, in a case where the rectangular tube body 17 serving as the frame of the outer shell 16 and the lid member 18 are separately formed, it is necessary to fix the lid member 18 to the one end surface of the rectangular tube body 17.

The method of fixing the lid member 18 to the rectangular tube body 17 of the outer shell 16 is not particularly limited, and any method may be used as long as the lid member 18 can be fixed to the opening end surface on one side of the rectangular tube body 17 so that the opening end surface is closed to become a node of a standing wave of the air column resonance. For example, a method using an adhesive, a method using a physical fixture, and the like can be mentioned.

In the method using an adhesive, an adhesive is applied onto the surface surrounding the opening end surface on the one side of the rectangular tube body 17 and the lid member 18 is placed thereon, so that the lid member 18 is fixed to the rectangular tube body 17 with the adhesive. Examples of the adhesive include epoxy based adhesives (Araldite (registered trademark) (manufactured by Nichiban Co., Ltd.) and the like), cyanoacrylate based adhesives (Aron Alpha (registered trademark) (manufactured by Toagosei Co., Ltd.) and the like), and acrylic based adhesives. Instead of using the adhesive directly, a double-sided tape (for example, a double-sided tape manufactured by Nitto Denko Corporation) having an adhesive on its both surfaces may be used.

As a method using a physical fixture, a method can be mentioned in which the lid member 18 disposed so as to cover the opening end surface on one side of the rectangular tube body 17 is interposed between the opening end surface on one side of the rectangular tube body 17 and a fixing member, such as a rod, and the fixing member is fixed to the rectangular tube body 17 by using a fixture, such as a screw.

In the soundproof structures 10, 10*a*, 10*b*, and 10*c* of the illustrated example, the two soundproof units 12 (12*a* and 12*b*, 12*c*, 12*d*, 12*e*, 12*f*, and 12*g*) are the same. However, the present invention is not limited thereto, and one soundproof unit 12 and the other soundproof unit 12 may be different soundproof units.

Here, the case where the two adjacent soundproof units 12 are different is a case where the shapes or structures of the two soundproof units 12 are different. For example, the case where the two adjacent soundproof units 12 are different may be a case where different two soundproof units 12 of the soundproof units 12*a* (or 12*b*), 12*c*, 12*d*, 12*e*, 12*f*, and 12*g* are combined, or may be a case where the outer shells 16 (16*a* and 16*b*), 16*c*, 16*e*, 16*f*, or 16*g* used as the two soundproof units 12, the rectangular tube bodies 17 and 17*c*, the bent tube body 17*b*, and the like are different, or may be a case where the two opening ends 14 (14*a* and 14*b*, 14*c*, 14*d*, or 14*e*) disposed so as to face each other are different.

In the soundproof structures 10, 10*a*, 10*b*, and 10*c* of the illustrated example, the two soundproof units 12 facing each other, that is, adjacent to each other so as to face each other are provided. However, the present invention is not limited thereto. As long as the two adjacent soundproof units 12 are included, three or more soundproof units 12 may be included.

Figure 9:
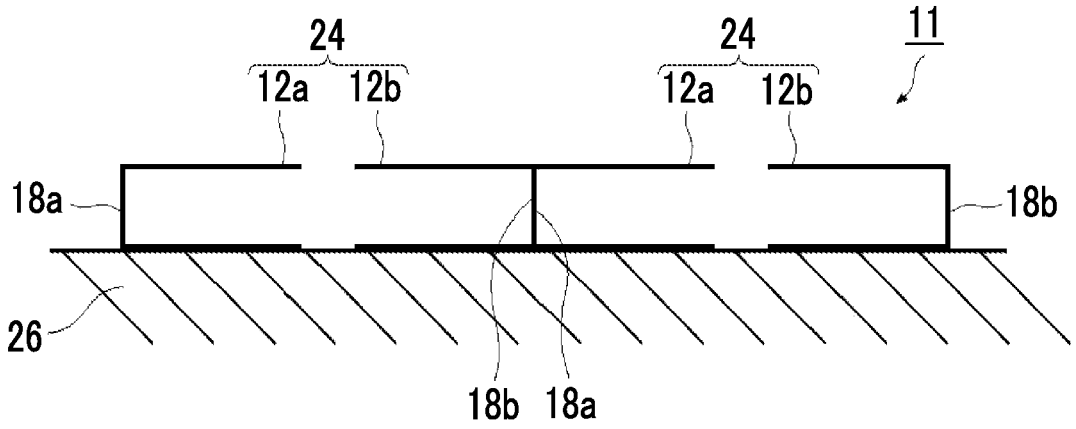
FIG. 9 is a schematic cross-sectional view of an example of a soundproof structure according to another embodiment of the present invention.

For example, as in a soundproof structure 11 shown in FIG. 9, the two soundproof units 12*a* and 12*b* of the soundproof structure 10 shown in FIG. 1 may be disposed as one soundproof unit set 24 on a wall 26 of the structure. In the example shown in FIG. 9, with a soundproof unit pair of the two soundproof units 12*a* and 12*b* as one soundproof unit set 24, two soundproof unit sets 24 are disposed on the wall 26 so that a lid member 18*b* of the soundproof unit 12*b* of the first soundproof unit set 24 and a lid member 18*a* of the soundproof unit 12*a* of the second soundproof unit set 24 are brought into contact with each other to be integrated. However, the present invention is not limited thereto. For example, two or more soundproof units may be set as one soundproof unit set, or three or more soundproof unit sets may be disposed on the wall. In addition, the rear plates of adjacent soundproof unit sets may be disposed so as to be spaced apart from each other, or may be completely integrated to form one rear plate.

Figure 31:
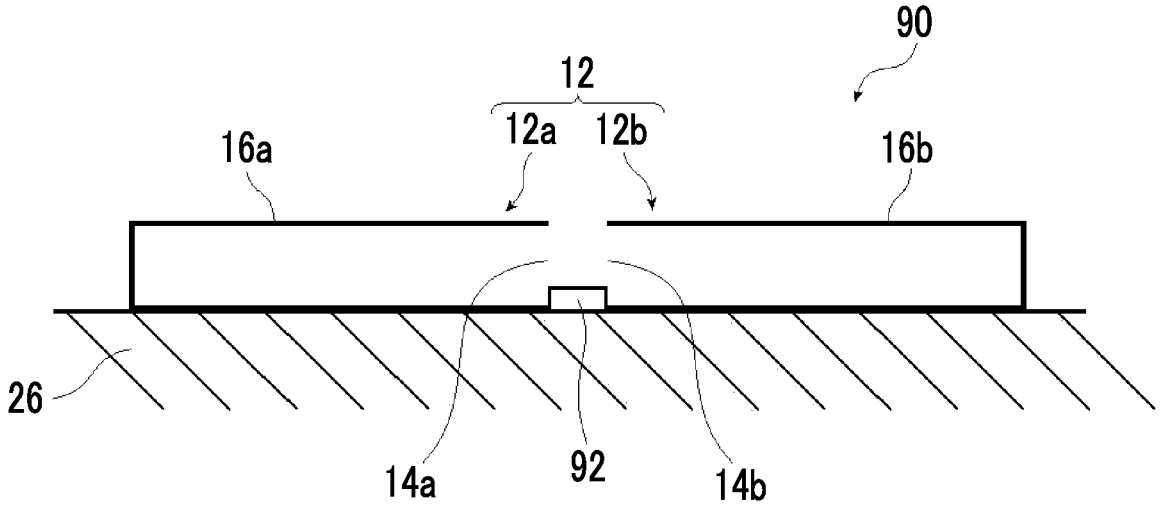
FIG. 31 is a schematic cross-sectional view of an example of a soundproof structure according to another embodiment of the present invention.

The method of fixing the two soundproof units 12*a* and 12*b* to the wall 26 of the structure is not particularly limited, and a known method can be used. However, as shown in a soundproof structure 90 in FIG. 31, it is possible to use a method in which a protrusion 92 is provided on the wall 26 of the structure and the end portion of the outer shell 16*a* and the end portion of the outer shell 16*b* of each soundproof unit are fixed to the respective end surfaces facing each other of the protrusion 92 such that the opening ends 14*a* and 14*b* of the two soundproof units 12*a* and 12*b* face each other. Since the protrusion 92 has a predetermined length, the two soundproof units can be easily disposed at positions where a predetermined distance between the opening ends 14*a* and 14*b* is maintained.

As a method of fixing each soundproof unit to the end surface of the protrusion 92, a method can be mentioned in which a hole portion or a recessed portion, into which the end portion of the outer shell 16*a* and the end portion of the outer shell 16*b* can be inserted, is formed in the protrusion 92.

Figure 10:
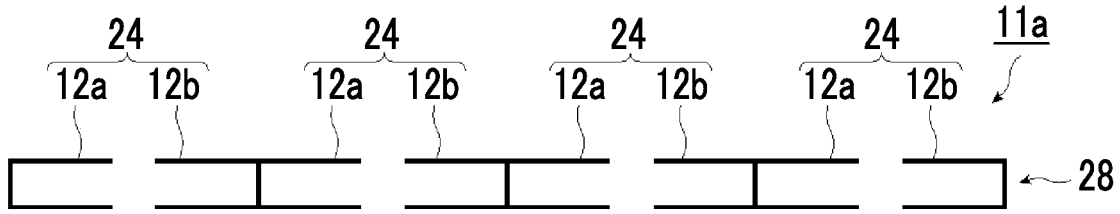
FIG. 10 is a schematic cross-sectional view of an example of a soundproof structure according to another embodiment of the present invention.

In addition, as in a soundproof structure 11*a* shown in FIG. 10, it is preferable that, with the two soundproof units 12*a* and 12*b* of the soundproof structure 10 shown in FIG. 1 as one soundproof unit set 24, a plurality of soundproof unit sets 24 (in the example shown in FIG. 10, four soundproof unit sets 24) are combined to function as a soundproof wall 28.

Figure 10A:
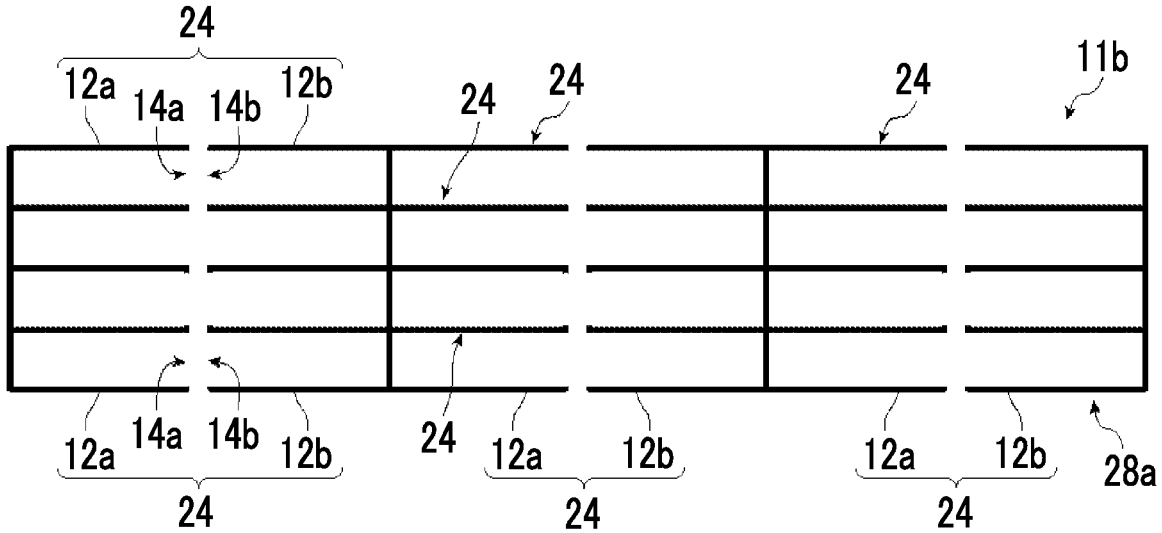
FIG. 10A is a schematic cross-sectional view of an example of a soundproof structure according to another embodiment of the present invention.

In addition, as in a soundproof structure 11*b* shown in FIG. 10A, it is preferable that a plurality of stages (in the example shown in FIG. 10A, four stages) of a straight line shaped combination of a plurality of soundproof unit sets 24 (for example, three soundproof unit sets 24) shown in FIG. 10 are combined in parallel to function as a new soundproof wall structure 28*a*. In the soundproof wall structure 28*a*, by stacking the slits 20 between the opening portions 14*a* and 14*b* of the two soundproof units 12*a* and 12*b* of the four soundproof unit sets 24 stacked at the same position so as to communicate with each other, it is possible to form an opening communicating the proximal portion to the outside.

Here, in the soundproof structures 11, 11*a*, and 11*b* shown in FIGS. 9 to 10A, it is preferable to arrange the soundproof unit set 24 periodically. In addition, it is preferable to form a soundproof structure by arranging a plurality of units with the soundproof unit sets 24 as a unit.

In the soundproof structures 11, 11*a*, and 11*b* shown in FIGS. 9 to 10A, one soundproof unit set 24 is not limited to the two soundproof units 12 (12*a* and 12*b*) of the soundproof structure 10 shown in FIG. 1, and may be at least one of the soundproof units 12*c*, 12*d*, 12*e*, 12*f*, or 12*g* shown in FIGS. 6 to 8B.

In the following description, the two soundproof units 12*a* and 12*b* of the soundproof structure 10 shown in FIG. 1 will be described as representative examples. However, it is needless to say that at least one of the soundproof units 12*c*, 12*d*, 12*e*, 12*f*, or 12*g* shown in FIGS. 6 to 8B may be used in the same manner as described above.

Figure 11:
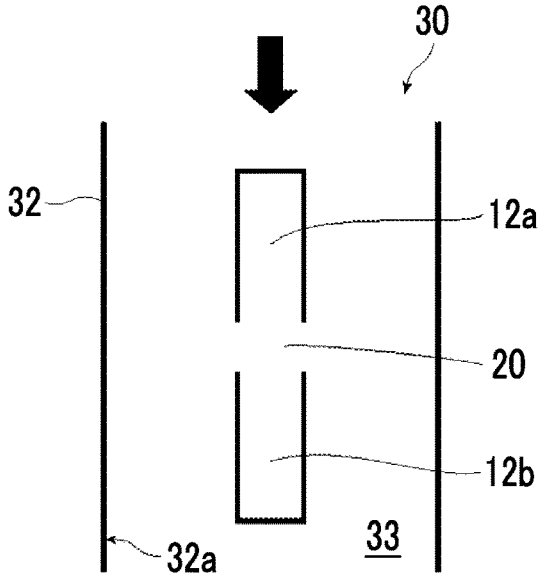
FIG. 11 is a schematic cross-sectional view of an example of a soundproof structure according to another embodiment of the present invention.

In addition, as in a soundproof structure 30 shown in FIG. 11, the two soundproof units 12*a* and 12*b* of the soundproof structure 10 shown in FIG. 1 may be disposed in a tubular member 32. The arrow indicates the incidence direction of sound. In this case, in the two soundproof units 12*a* and 12*b*, it is preferable that the slit 20 between the opening ends 14*a* and 14*b* is disposed in a direction (that is, a radial direction) perpendicular to the longitudinal direction (that is, sound incidence direction) of the tubular member 32.

Figure 12:
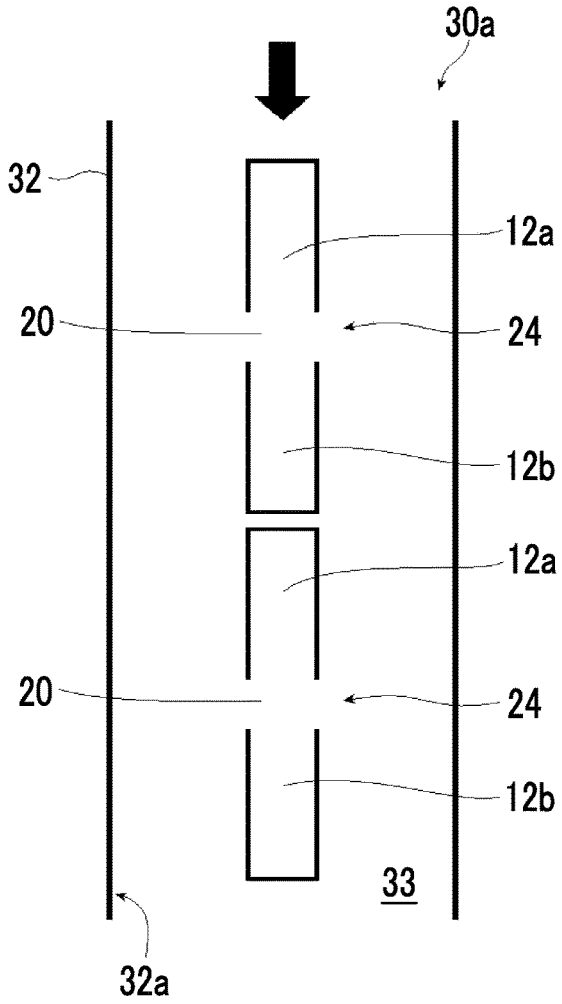
FIG. 12 is a schematic cross-sectional view of an example of a soundproof structure according to another embodiment of the present invention.

In addition, as in a soundproof structure 30*a* shown in FIG. 12, a plurality of soundproof unit sets 24 (in the example shown in FIG. 12, two soundproof unit sets 24), each of which is configured to include the two soundproof units 12*a* and 12*b* of the soundproof structure 10 shown in FIG. 1, may be disposed in the tubular member 32 side by side along the longitudinal direction such that the slit 20 between the opening ends 14*a* and 14*b* is in a direction (that is, a radial direction) perpendicular to the longitudinal direction (sound incidence direction indicated by the arrow) of the tubular member 32.

Also in this case, by increasing the number of soundproof unit sets 24, it is possible to increase the peak value of the absorbance at the absorption peak frequency.

Figure 13:
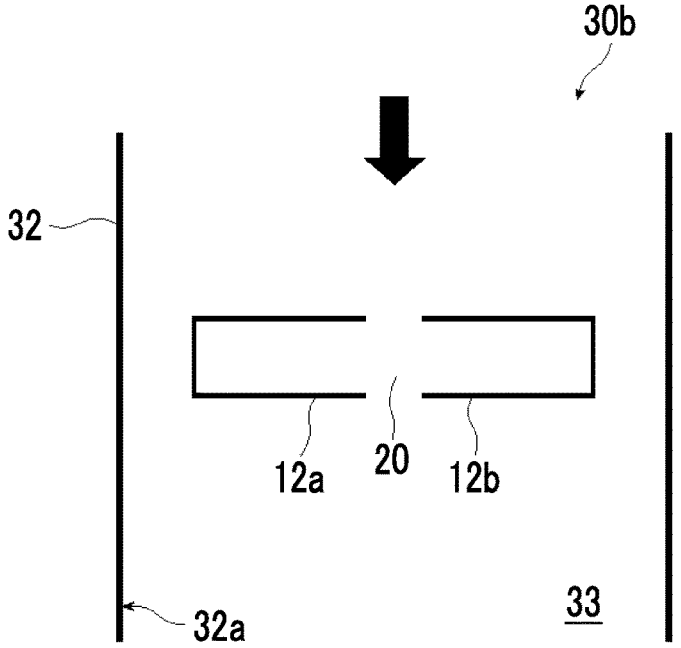
FIG. 13 is a schematic cross-sectional view of an example of a soundproof structure according to another embodiment of the present invention.

In addition, as in a soundproof structure 30*b* shown in FIG. 13, it is preferable that the two soundproof units 12*a* and 12*b* of the soundproof structure 10 shown in FIG. 1 are disposed in the tubular member 32 such that the slit 20 between the opening ends 14*a* and 14*b* is along the longitudinal direction (that is, sound incidence direction) of the tubular member 32 (preferably, the slit 20 between the opening ends 14*a* and 14*b* is parallel to the incidence direction of sound).

As in the soundproof structure 30*b* shown in FIG. 13, even in a case where the arrangement of the two soundproof units 12*a* and 12*b* is changed by 90° with respect to the soundproof structure 30 shown in FIG. 11, the absorption peak frequency hardly changes regardless of the arrangement method. Therefore, there is robustness with regard to the direction of the soundproof unit.

Figure 14:
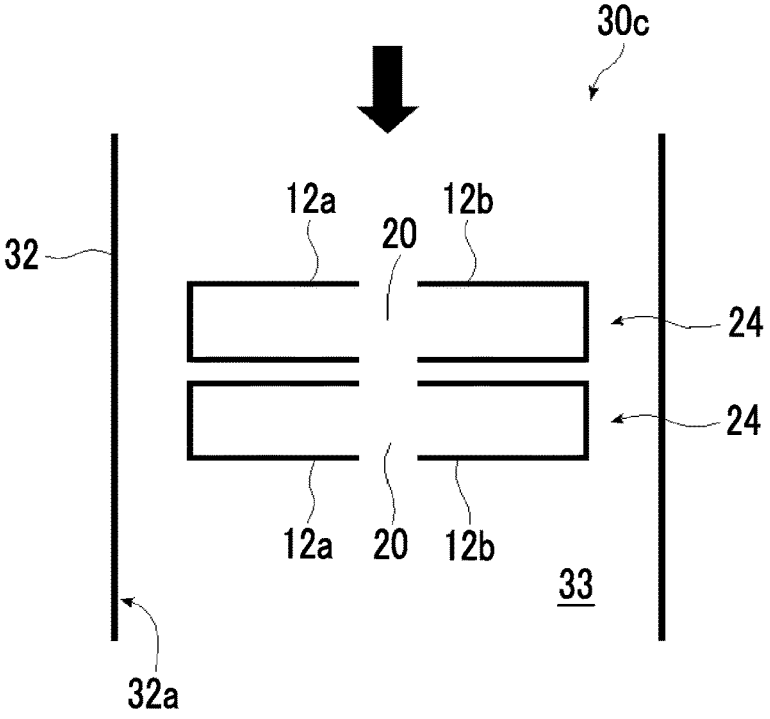
FIG. 14 is a schematic cross-sectional view of an example of a soundproof structure according to another embodiment of the present invention.

In addition, as in a soundproof structure 30*c* shown in FIG. 14, it is preferable that a plurality of soundproof unit sets 24 (in the illustrated example, two soundproof unit sets 24), each of which is configured to include the two soundproof units 12*a* and 12*b* of the soundproof structure 10 shown in FIG. 1, are disposed in the tubular member 32 along the longitudinal direction. Also in this case, in the soundproof unit set 24, it is preferable that the slit 20 is disposed along the longitudinal direction (that is, sound incidence direction indicated by the arrow) of the tubular member 32 (preferably, in parallel to the incidence direction of sound). By increasing the number of soundproof unit sets 24, it is possible to increase the peak value of the absorbance at the absorption peak frequency.

Figure 15:
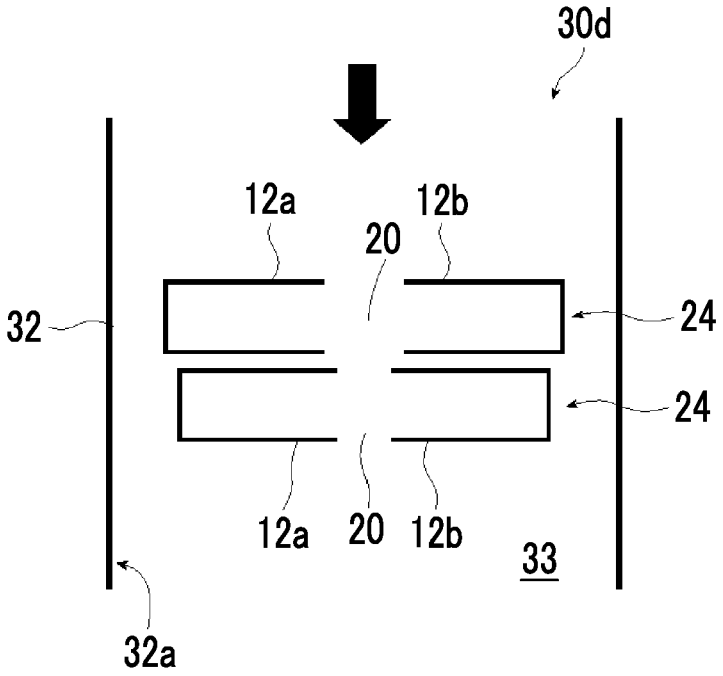
FIG. 15 is a schematic cross-sectional view of an example of a soundproof structure according to another embodiment of the present invention.

As in a soundproof structure 30*d* shown in FIG. 15, a plurality of soundproof unit sets 24 (in the example shown in FIG. 15, two soundproof unit sets 24), each of which is configured to include the two soundproof units 12*a* and 12*b* of the soundproof structure 10 shown in FIG. 1, may be disposed in the tubular member 32 along the longitudinal direction, and the interval (that is, the width of the slit 20) between the opening ends 14*a* and 14*b* of the two soundproof units 12*a* and 12*b* of one of the soundproof unit sets 24 may be different from that of the other soundproof unit set 24. Also in this case, the slits 20 of the two soundproof unit sets 24 have different widths, but are parallel in a direction (preferably, sound incidence direction) extending along the longitudinal direction (sound incidence direction indicated by the arrow) of the tubular member 32. Since the widths of the slits 20 of the soundproof unit sets 24 are different, the absorption peak frequencies of the soundproof unit sets 24 are slightly different. Therefore, since there are a plurality of (for example, two) absorption peak frequencies, the absorption band can be widened on the low frequency side.

In the soundproof structures 30 and 30*a* to 30*d* shown in FIGS. 11 to 15, it is preferable that the soundproof unit set 24 configured to include the two soundproof units 12*a* and 12*b* is disposed approximately at the center of an inner hole portion 33 of the tubular member 32 and a space between the inner wall (that is, an inner wall surface 32*a*) of the tubular member 32 and the soundproof units 12*a* and 12*b* is opened along the longitudinal direction (sound incidence direction indicated by the arrow).

Figure 16:
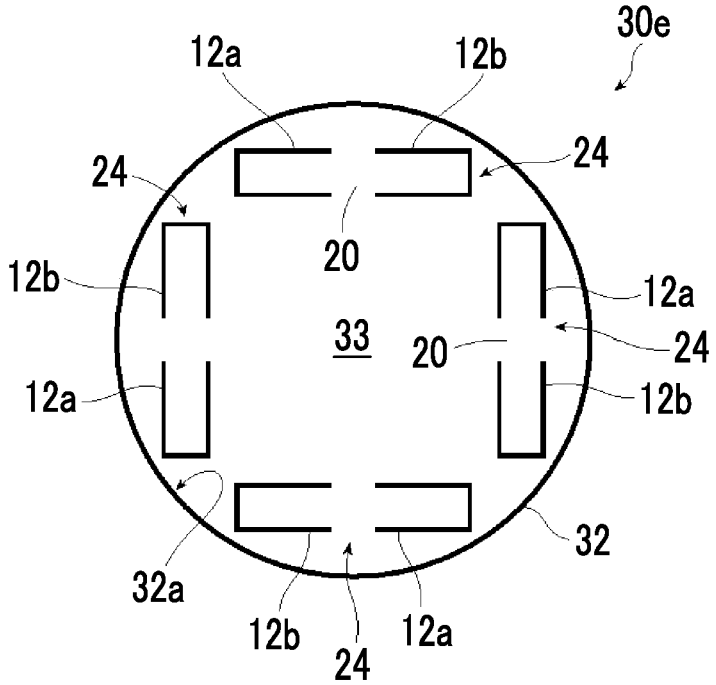
FIG. 16 is a schematic cross-sectional view of an example of a soundproof structure according to another embodiment of the present invention.

In addition, as in a soundproof structure 30*e* shown in FIG. 16, a plurality of soundproof unit sets 24 (in the example shown in FIG. 16, four soundproof unit sets 24), each of which is configured to include the two soundproof units 12*a* and 12*b* of the soundproof structure 10 shown in FIG. 1, may be disposed in the tubular member 32 along the inner wall surface 32*a*. In this case, all of the two soundproof units 12*a* and 12*b* of each soundproof unit set 24 are disposed along the wall, and the slit 20 between the opening ends 14*a* and 14*b* is disposed so as to be parallel along the longitudinal direction (that is, sound incidence direction) of the tubular member 32 (preferably, in the incidence direction of sound) and so as to be directed toward the center of the hole portion 33 of the tubular member 32.

Figure 17:
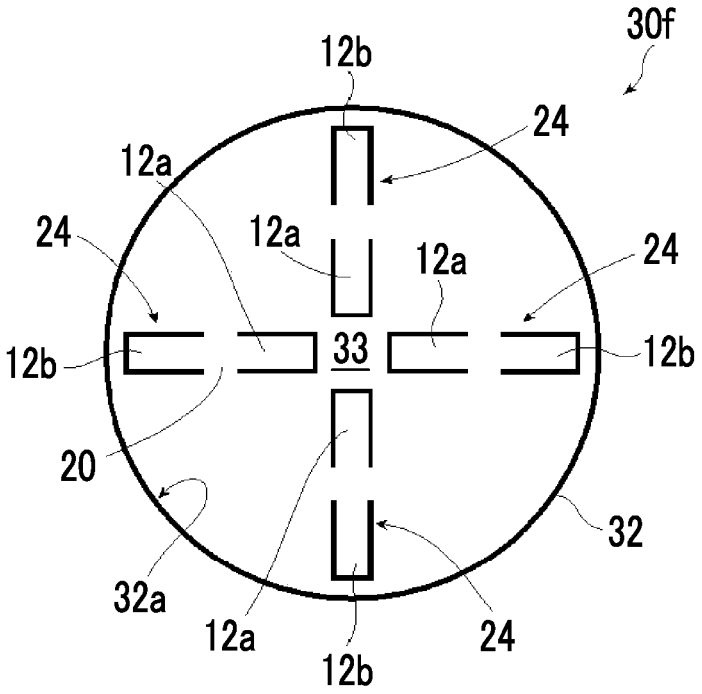
FIG. 17 is a schematic cross-sectional view of an example of a soundproof structure according to another embodiment of the present invention.

In addition, as in a soundproof structure 30*f* shown in FIG. 17, a plurality of soundproof unit sets 24 (in the example shown in FIG. 17, four soundproof unit sets 24), each of which is configured to include the two soundproof units 12*a* and 12*b* of the soundproof structure 10 shown in FIG. 1, may be disposed in the tubular member 32 along the inner wall surface 32*a*. In this case, one (in the illustrated example, the soundproof unit 12*b*) of the two soundproof units 12*a* and 12*b* of each soundproof unit set 24 is disposed along the wall, and the slit 20 between the opening ends 14*a* and 14*b* is disposed so as to be parallel along the longitudinal direction (that is, sound incidence direction) of the tubular member 32 (preferably, in the incidence direction of sound) and so as to be directed in the circumferential direction of the hole portion 33 of the tubular member 32.

In the soundproof structures 30*e* and 30*f* shown in FIGS. 16 and 17, a central portion of the hole portion 33 of the tubular member 32 and a space between the adjacent soundproof unit sets 24 are opened along the longitudinal direction (sound incidence direction indicated by the arrow).

The soundproof unit used in the present invention and the soundproof structure according to the embodiment of the present invention using the two soundproof units are basically configured as described above.

Figure 18:
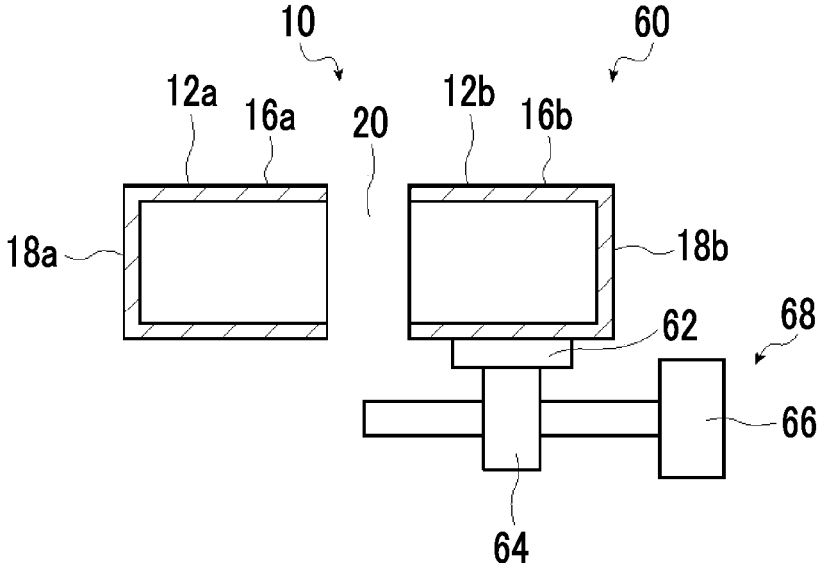
FIG. 18 is a schematic cross-sectional view of an example of a soundproof structure according to another embodiment of the present invention.

A soundproof structure 60 shown in FIG. 18 comprises the soundproof structure 10 shown in FIG. 1, a mounting table 62 for mounting and supporting the soundproof unit 12*b* of the soundproof structure 10, a traveling nut 64 fixed to the mounting table 62, and a drive screw 66 screwed to the traveling nut 64, and has a screw moving mechanism 68 that moves the soundproof unit 12*b* with respect to the soundproof unit 12*a* of the soundproof structure 10.

Here, the soundproof unit 12*a* of the soundproof structure 10 is supported by a base (not shown), and the drive screw 66, such as a ball screw, is rotatably supported on the base.

In this manner, by rotating the drive screw 66 manually or automatically to move the soundproof unit 12*b* with respect to the soundproof unit 12*a*, the average distance between the opening end 14*a* of the soundproof unit 12*a* and the opening end 14*b* of the soundproof unit 12*b* can be changed. Therefore, it is possible to adjust the absorption peak frequency at which the absorbance is the peak.

In a case where a moving mechanism such as the screw moving mechanism 68 is an automatic moving mechanism that moves automatically, the moving mechanism comprises a driving source, such as a motor, and a control unit for controlling the driving of the driving source, which are not shown. The control unit automatically controls the driving source according to the movement amount given to the control unit, so that it is possible to perform automatic movement by the movement amount.

Here, the screw moving mechanism 68 in the example shown in FIG. 18 moves the soundproof unit 12*b* with respect to the soundproof unit 12*a*, the present invention is not limited thereto. A moving mechanism for moving the soundproof unit 12*a* with respect to the soundproof unit 12*b* may be used, or a moving mechanism for moving both of the soundproof units 12*a* and 12*b* may be used.

That is, the moving mechanism used in the present invention may change the average distance between the two opening ends 14*a* and 14*b* by moving one of the soundproof units 12*a* and 12*b* relatively with respect to the other one.

Such a moving mechanism is not particularly limited, and any moving mechanism may be used as long as at least one of the two adjacent soundproof units 12*a* and 12*b* can be moved. For example, in addition to the screw moving mechanism 68 in the illustrated example, although not shown, a rail traveling mechanism comprising a rail and a wheel on which at least one of the two adjacent soundproof units 12*a* and 12*b* is mounted and which travels on the rail, a rack to which at least one of the two adjacent soundproof units 12*a* and 12*b* is attached, a rack and pinion mechanism with pinion engaged with the rack, and a moving mechanism such as a piezoactuator using a piezoelectric element can be mentioned.

The soundproof structure such as the soundproof structure 60 comprising the screw moving mechanism 68 described above can also be configured as a soundproof system that appropriately insulates sound according to noise from a noise source.

Figure 19:
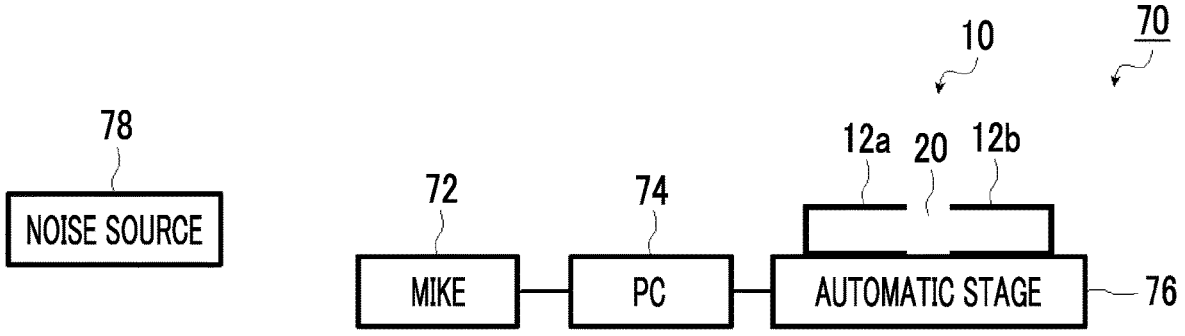
FIG. 19 is a schematic cross-sectional view of an example of a soundproof system according to an embodiment of the present invention.

A soundproof system 70 shown in FIG. 19 is a system that causes absorption at an appropriate frequency by automatically adjusting the absorption peak frequency by adjusting the distance between the opening ends with respect to the noise source, and appropriately insulates, that is, shields noise by adjusting the absorption peak frequency of the soundproof structure according to the frequency of the noise of the surrounding environment of the soundproof structure, in particular, the frequency of the noise from the noise source, so that the absorption peak frequency matches the frequency of the noise or the absorption peak frequency is as close as possible to the frequency of the noise.

The soundproof system 70 has the soundproof structure 10 comprising the two adjacent soundproof units 12*a* and 12*b* shown in FIG. 1, a microphone (hereinafter, simply referred to as a mike) 72 for measuring the noise of a noise source 78 in the surrounding environment of the soundproof structure 10, a personal computer (hereinafter, referred to as a PC) 74 for analyzing the frequency of the noise measured by the mike 72, and an automatic stage 76 for changing the distance between the opening ends 14*a* and 14*b* of the two adjacent soundproof units 12*a* and 12*b* according to the analysis result of the PC 74.

Here, the mike 72 is a measurement device for measuring the sound pressure of the noise from the noise source 78 in the surrounding environment of the soundproof structure 10, and configures a measurement unit. In this case, it is preferable that the position of the mike 72 is located closer to the noise source 78 than the soundproof structure 10. However, the mike 72 can be disposed anywhere as long as noise can be measured, so that analysis can be made anywhere.

The PC 74 receives sound pressure data of the noise measured by the mike 72, converts the sound pressure data into frequency characteristics, that is, frequency spectrum, and determines a soundproofing target frequency to be soundproofed or muffled. The soundproofing target frequency is not particularly limited, and is preferably a frequency of maximum sound pressure in the audible range. For example, it is preferable to determine the soundproofing target frequency on the assumption that it is desired to remove the maximum value in the frequency spectrum (that is, assuming a frequency to be shielded).

Then, the PC 74 calculates an average distance (hereinafter, referred to as an interlayer distance) between the opening ends 14*a* and 14*b* corresponding to the soundproofing target frequency. Specifically, the PC 74 refers to data stored in advance in a storage unit, such as a memory, and determines the interlayer distance between the opening ends 14*a* and 14*b* corresponding to or closest to the soundproofing target frequency (that is, the absorption peak frequency is the soundproofing target frequency) from the data. Here, the PC 74 is a frequency spectrum analyzer, and configures an analysis unit. The data stored in the memory of the PC 74 is a look-up table (that is, a correspondence table (data) between interlayer distances and frequencies) showing the relationship between the interlayer distance between the opening ends 14*a* and 14*b* of the two adjacent soundproof units 12*a* and 12*b* and the absorption peak frequency.

In such a correspondence table, it is preferable to measure in advance the relationship between the interlayer distance between the opening ends 14*a* and 14*b* and the absorption peak frequency and determine the interlayer distance between the opening ends 14*a* and 14*b* based on the actually measured value.

The PC 74 transmits (inputs) the interlayer distance between the opening ends 14*a* and 14*b* determined in this manner to the automatic stage 76.

Although not shown, the automatic stage 76 is an automatic moving mechanism comprising a moving mechanism such as the screw moving mechanism 68 shown in FIG. 18, a driving source such as a motor, and a control unit such as a controller for controlling the driving of the driving source. The automatic stage 76 adjusts the absorption peak frequency of the soundproof structure 10 by moving at least one of the two adjacent soundproof units 12*a* and 12*b* so as to have an interlayer distance between the opening ends 14*a* and 14*b* received from the PC 74, thereby matching the absorption peak frequency to the soundproofing target frequency.

In this manner, the soundproof system 70 according to the embodiment of the present invention can appropriately muffle the noise of the soundproofing target frequency.

Although the soundproof system 70 in the illustrated example comprises the automatic stage 76, the soundproof system 70 may comprise only a moving mechanism instead of the automatic stage 76. In that case, the moving mechanism may be manually moved according to the interlayer distance determined by the PC 74.

In a case where the PC 74 does not have a correspondence table between interlayer distances and frequencies prepared in advance, feedback may be written in the automatic stage 76 while taking the sound pressure by using two mikes.

Figure 20:
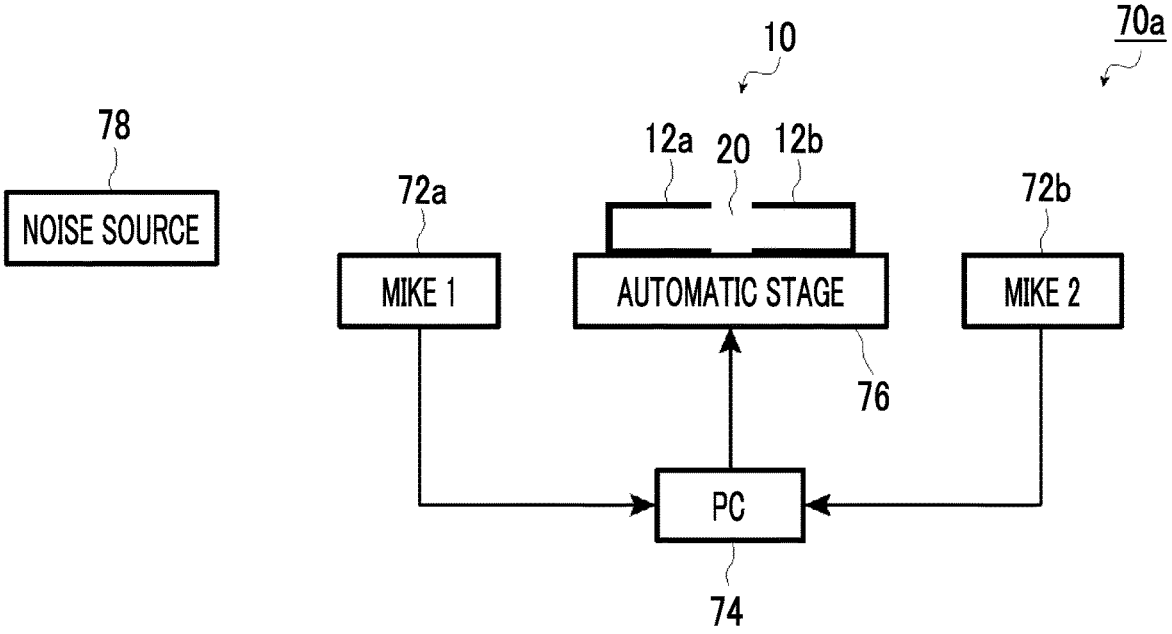
FIG. 20 is a schematic cross-sectional view of an example of a soundproof system according to another embodiment of the present invention.

A soundproof system 70*a* shown in FIG. 20 is an automatic soundproof system that comprises a feedback mechanism and adjusts the interlayer distance so that the absorption frequency of the soundproof structure matches the soundproofing target frequency while applying feedback, without creating the correspondence table of absorption frequency and interlayer distance in advance, and is a system that can make an automatic muffling mechanism function even in a case where the device characteristics of the soundproof structure change.

The soundproof system 70*a* has the soundproof structure 10, two mikes (mike 1) 72*a* and (mike 2) 72*b*, the automatic stage 76, and the PC 74.

Similarly to the soundproof system 70, in the soundproof system 70*a*, the sound pressure of noise is measured by at least one mike of the two mikes 72*a* and 72*b*, and the soundproofing target frequency is determined from the spectrum information (frequency spectrum data) of the mike by the PC 74.

The two mikes 72*a* and 72*b* measure the sound pressure at the soundproofing target frequency of the noise from the noise source 78. Here, one mike, for example, the mike 72*a* takes noise with a larger sound pressure at the soundproofing target frequency, and the other mike, for example, the mike 72*b* takes noise with a smaller sound pressure at the soundproofing target frequency. Here, as shown in FIG. 20, it can be determined that the mike 72*a* with a larger sound pressure is on the noise source 78 side. The larger sound pressure at the soundproofing target frequency of the mike 72*a* is set to be p1, and the smaller sound pressure at the soundproofing target frequency of the mike 72*b* is set to be p2.

In the soundproof system 70*a*, feedback adjustment is performed by the automatic stage 76 so that the smaller sound pressure p2 is minimized with respect to the larger sound pressure p1, that is, p2/p1 is minimized.

First, a sound pressure ratio abs(p2)/abs(p1) before moving the automatic stage 76 is measured using the two mikes 72*a* and 72*b*.

Then, the sound pressure ratio abs(p2)/abs(p1) is measured while moving the automatic stage 76. By searching for an interlayer distance at which the sound pressure ratio abs(p2)/abs(p1) is minimized among these, it is possible to determine an appropriate interlayer distance.

Finally, by matching the absorption frequency to the soundproofing target frequency by adjusting the interlayer distance with the automatic stage 76 so as to match the appropriate interlayer distance, it is possible to reduce the noise of the soundproofing target frequency most.

In the illustrated example, noise with a larger sound pressure and noise with a smaller sound pressure taken by the two mikes 72*a* and 72*b* are transmitted to the PC 74, the sound pressure ratio p2/p1 is calculated, and feedback adjustment is performed by the automatic stage 76. However, the present invention is not limited thereto, and the outputs of the two mikes 72*a* and 72*b* may be directly transmitted to the direct automatic stage 76 without passing through the PC 74.

Hereinafter, the physical properties or characteristics of a structural member that can be combined with a soundproof member having the soundproof structure according to the embodiment of the present invention will be described.

[Flame Retardancy]

In the case of using a soundproof member having the soundproof structure according to the embodiment of the present invention as a soundproof material in a building or a device, flame retardancy is required.

For this reason, the outer shell (tube body (frame) and lid member) are also preferably a flame-retardant material. A metal such as aluminum, an inorganic material such as ceramic, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FR1 (manufactured by Mitsubishi Rayon Co., Ltd.)) can be mentioned.

As a method of fixing the lid member to the tube body (frame), a bonding method using a flame-retardant adhesive (Three Bond 1537 series (manufactured by Three Bond Co. Ltd.)) or solder or a mechanical fixing method, such as fixing the lid member to the tube body (frame) with a screw or the like, is preferable.

[Heat Resistance]

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the outer shell (tube body (frame) and lid member), it is preferable to use heat resistant plastics, such as polyimide resin (TECASINT 4111 (manufactured by Enzinger Japan Co., Ltd.)) and/or glass fiber reinforced resin (TECAPEEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to the lid member or the tube body (frame), it is preferable to set the thickness to 1 μm or less so that the amount of expansion and contraction can be reduced.

[Weather Resistance and Light Resistance]

In a case where the soundproof member having the soundproof structure according to the embodiment of the present invention is disposed outdoors or in a place where light is incident, the weather resistance of the structural member becomes a problem.

Therefore, as the material of the outer shell (tube body (frame) and lid member), it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select an outer shell (tube body (frame) and lid member) and an adhesive having high moisture resistance. Regarding water absorption and chemical resistance, it is preferable to appropriately select an appropriate outer shell (tube body (frame) and lid member) and adhesive.

The soundproof structure and the soundproof system according to the embodiment of the present invention are basically configured as described above.

Since the soundproof structure and the soundproof system according to the embodiment of the present invention are configured as described above, low-frequency shielding that is difficult in the conventional soundproof structure can be realized and the frequency can be lowered. In addition, since the absorption peak frequency can be adjusted in the low frequency region, there is also a feature that it is possible to design a structure that is strongly soundproofed or insulated according to noise of various frequencies.

The soundproof structure according to the embodiment of the present invention can be used as the following soundproof members.

For example, as soundproof members having the soundproof structure according to the embodiment of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening portion (soundproof member installed in the window of a room to prevent noise from indoor or outdoor); a soundproof member for ceiling (soundproof member installed on the ceiling of a room to control the sound in the room); a soundproof member for floor (soundproof member installed on the floor to control the sound in the room); a soundproof member for internal opening portion (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member that covers the construction site and prevents leakage of noise around the construction site); and a soundproof member for tunnel (soundproof member installed in a tunnel to prevent noise leaking to the inside and outside the tunnel).

EXAMPLES

The soundproof structure according to the embodiment of the present invention will be specifically described by way of examples.

First, a single soundproof unit (single cell) used in the soundproof structure according to the embodiment of the present invention was manufactured as Reference example 1.

Reference Example 1

First, as Reference example 1, the soundproof unit (single cell) 12 shown in FIG. 4 was manufactured.

Using an acrylic plate having a thickness Ls of 2 mm as the side plate-shaped member 17*a* of the rectangular tube body 17 of the outer shell 16, the rectangular tube body 17 having a cylindrical structure opened at both ends was manufactured. The rectangular tube body 17 had a square shape in which the size Lt of the outer shell 16 (the length of the rectangular tube body 17), that is, the length Lt of the side plate-shaped member 17*a* interposed between the opening portion 14 and the lid member 18 was 30 mm and the (inner) size Lo of one side of the opening portion 14 was 10 mm. As the lid member 18, an acrylic plate having a square shape with a side length of 14 mm and a thickness Lc of 2 mm was prepared. The lid member 18 was attached to one surface of the rectangular tube body 17 having a cylindrical structure. As a method for attaching the lid member 18 to the rectangular tube body 17, a double-sided tape (manufactured by Nitto Denko Corporation) was attached to the frame portion of the end surface of the cylindrical structure of the rectangular tube body 17. In this manner, the soundproof unit (single cell) 12 having a cylindrical structure in which the size Lt of the outer shell 16 was 30 mm was manufactured.

The soundproof unit 12 of the single cell was measured.

The acoustic characteristics were measured by a transfer function method using four mikes in a self-made acrylic acoustic tube (tubular member 32: refer to FIG. 11). This method is based on "ASTM E2611-09: Standard Test Method for Measurement of Normal Incidence Sound Transmission of Acoustical Materials Based on the Transfer Matrix Method". As the acoustic tube (32), for example, an acoustic tube based on the same measurement principle as WinZac manufactured by Nippon Sound Engineering Co., Ltd. was used. It is possible to measure the sound transmission loss in a wide spectral band using this method. In particular, by measuring the transmittance and the reflectivity at the same time, the absorbance of the sample was also accurately measured. The sound transmission loss was measured in the range of 100 Hz to 4000 Hz.

Figure 21:
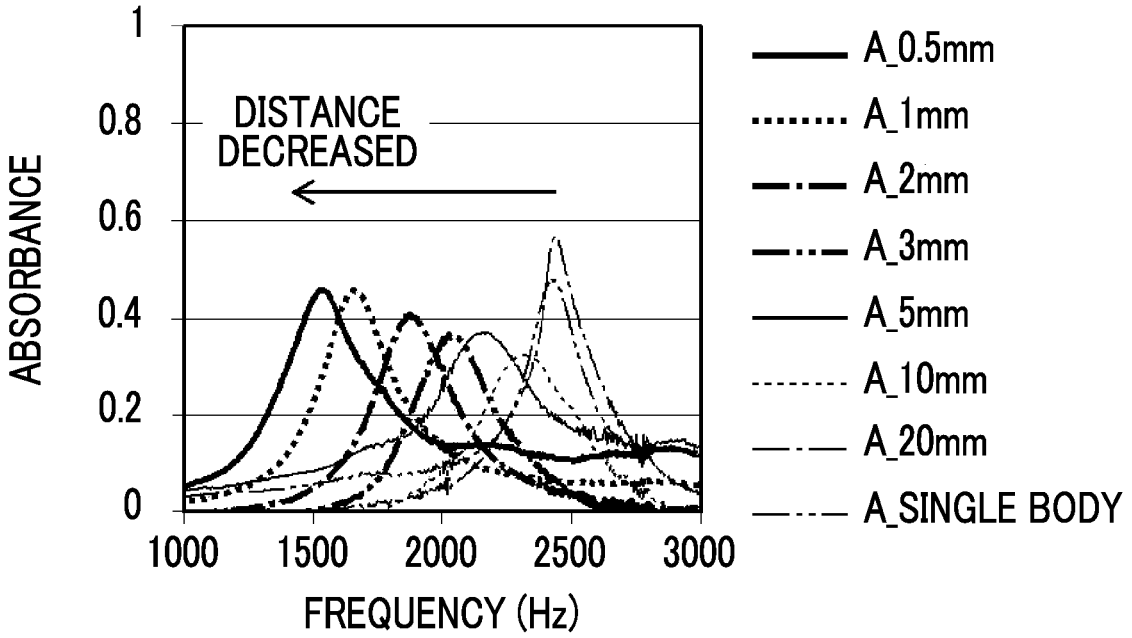
FIG. 21 is a graph showing the sound absorption characteristics of soundproof structures of Examples 1 to 6 of the present invention.
Figure 22:
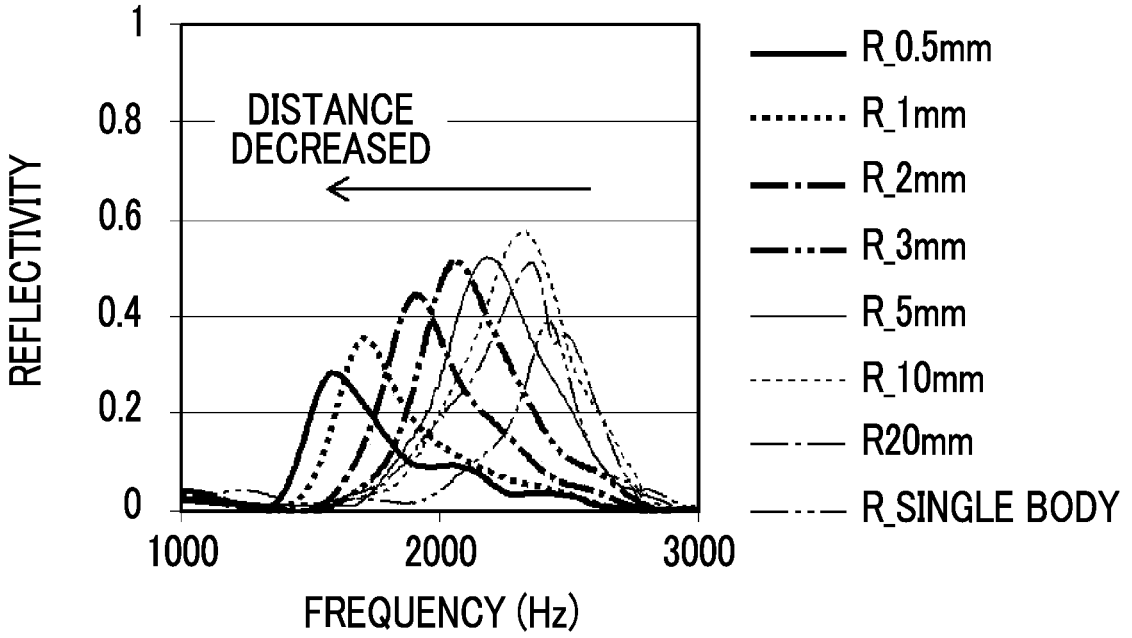
FIG. 22 is a graph showing the sound reflection characteristics of soundproof structures of Examples 1 to 6 of the present invention.

The inner diameter of the acoustic tube (32) is 40 mm, and can be sufficiently measured up to 4000 Hz or higher. The acoustic characteristics of the soundproof unit 12 of a single cell were measured using the transfer function method. The arrangement was that the opening end 14 of the soundproof unit 12 of the single cell was parallel to the cross section of the acoustic tube (32) (the opening end 14 was perpendicular to the longitudinal direction of the acoustic tube (32)). Considering the cross section including the soundproof unit 12 of the single cell, the soundproof unit 12 of the single cell occupies only 16% of the acoustic tube (32). That is, approximately 84% of the acoustic tube (32) is an opening portion. The transmittance and the reflectivity were measured in this measurement, and the absorbance was calculated as (1-transmittance-reflectivity). The absorbance calculated in this manner is shown in FIG. 21, and the reflectivity is shown in FIG. 22.

The measurement results (absorption peak frequency and frequency difference from the single body) of Reference example 1 are shown in Table 1.

Example 1

Next, a total of two soundproof units 12 of the single cell described above were manufactured. As in the case of the soundproof structure 10 shown in FIG. 1, as an arrangement in which the opening portions 14 (14*a* and 14*b*) of the two soundproof units 12 faced each other, the interlayer distance between the opening portions 14 (14*a* and 14*b*) was adjusted to 0.5 mm. The acoustic characteristics of the soundproof structure 10 in which the two soundproof units 12 faced each other were measured. As in the soundproof structure 30 shown in FIG. 11, the arrangement was that the two opening ends 14 (14*a* and 14*b*) were parallel to the cross section of the acoustic tube (32), that is, the two opening ends 14 (14*a* and 14*b*) faced each other as in the arrangement of Reference example 1.

In the measurement of Example 1, the transmittance and the reflectivity were measured, and the absorbance was calculated as (1−transmittance-reflectivity). The absorbance calculated in this manner is shown in FIG. 21, and the reflectivity is shown in FIG. 22.

The measurement results (absorption peak frequency and frequency difference from the single body) of Example 1 are shown in Table 1.

Hereinafter, unless otherwise stated, measure was performed under the arrangement based on the same arrangement method as in Example 1.

Examples 2 to 6 and Comparative Example 1

In the same manner as in Example 1, the acoustic characteristics were measured with the distance between the opening portions 14 as 1 mm (Example 2), 2 mm (Example 3), 3 mm (Example 4), 5 mm (Example 5), 10 mm (Example 6), and 20 mm (Comparative example 1).

Including Example 1 and Reference example 1, the frequency dependencies of the absorbance and the reflectivity of the measurement results of Examples 2 to 6 and Comparative example 1 are shown in FIGS. 21 and 22. In addition, these results (absorption peak frequency and frequency difference from the single body) are summarized in Table 1.

TABLE 1

| | Distance (mm) | Absorption peak frequency | Frequency difference from single body |
|---|---|---|---|
| Example 1 | 0.5 | 1540 | 885 |
| Example 2 | 1 | 1665 | 760 |
| Example 3 | 2 | 1880 | 545 |
| Example 4 | 3 | 2030 | 395 |
| Example 5 | 5 | 2160 | 265 |
| Example 6 | 10 | 2310 | 115 |
| Comparative example 1 | 20 | 2440 | −15 |
| Reference example 1 | Single body | 2425 | — |

As is apparent from FIGS. 21 and 22 and Table 1, it can be seen that both the absorption peak and the reflection peak become closer to the low frequency side as the distance between the opening ends 14 (14*a* and 14*b*) becomes smaller. In particular, in Example 1, the absorption peak and the reflection peak could be shifted to the low frequency side by 885 Hz from the absorption peak frequency of the soundproof unit 12 of the single cell in Reference example 1 by decreasing the distance between the opening ends 14 (14*a* and 14*b*) to 0.5 mm. In addition, it is understood that even if the distance between the opening ends 14 (14*a* and 14*b*) is significantly reduced by decreasing the distance between the opening ends 14 (14*a* and 14*b*), the absorption amount is kept large.

As is apparent from FIG. 21, in Comparative example 1, the distance between the opening ends 14 (14*a* and 14*b*) is as large as 20 mm. Therefore, it could be seen that the frequency of the absorption peak was approximately the same as the frequency of the absorption peak of the single soundproof unit in Reference example 1 and that no low frequency shift was observed. As is apparent from FIG. 22, in Comparative example 1, it could be seen that the frequency of the reflection peak was close to the frequency of the absorption peak of the single soundproof unit in Reference example 1 and that the low frequency shift was small.

Figure 23:
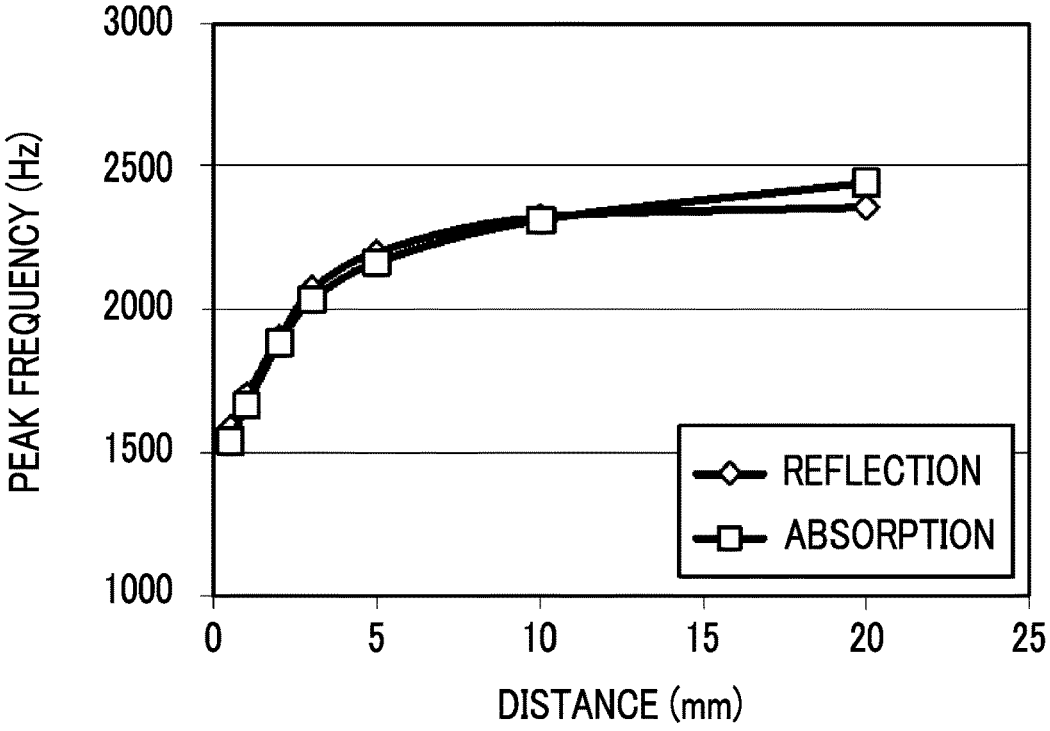
FIG. 23 is a graph showing the relationship between the peak frequency and the proximity distance between opening ends in the soundproof structures of Examples 1 to 6 of the present invention.
Figure 24:
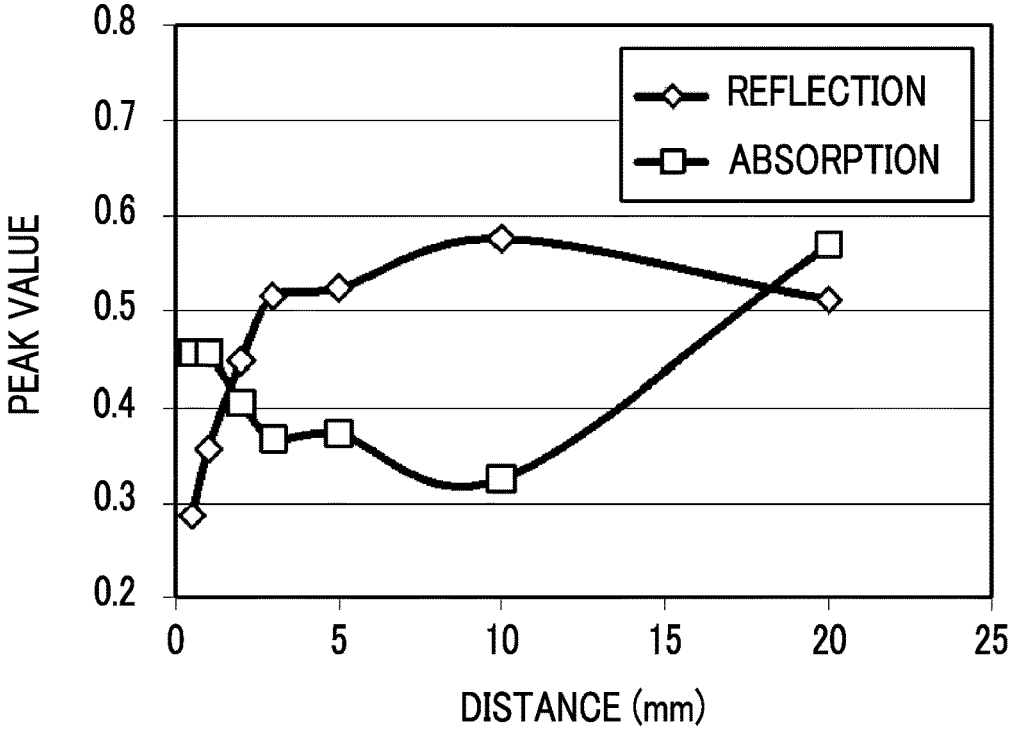
FIG. 24 is a graph showing the relationship between the peak value and the proximity distance between opening ends in the soundproof structures of Examples 1 to 6 of the present invention.

From these results, FIG. 23 shows the shift of the peak frequency with respect to the distance for absorption and reflection. It is understood that the peak is shifted to the lower frequency as the distance becomes smaller, in particular, the shift amount increases in a case where the distance becomes 5 mm or less. FIG. 24 shows peak values of the transmittance and the absorbance. It can be seen that the reflection is large at 10 mm, which is a relatively large distance, and the absorption becomes dominant by decreasing the distance. That is, there is a feature that the frequency is lowered and the absorbance is increased in a case where the distance is reduced. In the case of insulating sound in a duct inside the equipment, in a case where sound is returned by reflection, the sound may leak out from another place. Therefore, since it is very useful to use a soundproof member to absorb the sound, this is particularly suitable for such parts. It can be seen that this member has a feature of absorbing low frequencies compactly.

Reference Example 2

Next, using a 3D printer, the rectangular tube body (frame) 17 having a cylindrical structure with both ends opened was created in which the thickness Ls was 3 mm, the (inner) size Lo of the opening portion 14 was 15 mm×46 mm, and the size of the outer shell 16 and the length (frame thickness) Lt of the rectangular tube body 17 were 35 mm. The material was ABS resin. As the lid member 18, an acrylic plate having a rectangular shape of 21 mm×52 mm and a thickness of 3 mm was prepared. The plate was fixed to one surface of the rectangular tube body 17 having a cylindrical structure, thereby forming the lid member 18. The lid member 18 was fixed to the rectangular tube body 17 with a double-sided tape so that there was no gap therebetween in the same manner as in Example 1. In this manner, the soundproof unit (single cell) 12 having a cylindrical structure larger than that of Example 1 was manufactured as Reference example 2.

The soundproof unit 12 of the single cell of Reference Example 2 was measured in the same manner as in Example 1.

Example 7

Next, a total of two soundproof units 12 of the single cell described above were manufactured.

The acoustic characteristics were measured by a transfer function method in the same manner as in Example 1 except that a self-made acoustic tube (tubular member 32: refer to FIG. 11) having a diameter of 80 mm was used. As in the case of the soundproof structure 10 shown in FIG. 1, as an arrangement in which the opening portions 14 (14*a* and 14*b*) of the two soundproof units 12 faced each other, the interlayer distance between the opening portions 14 (14*a* and 14*b*) was adjusted to 1.0 mm. The acoustic characteristics of the soundproof structure 10 in which the two soundproof units 12 faced each other were measured. As in the soundproof structure 30 shown in FIG. 11, the arrangement was that the two opening ends 14 (14*a* and 14*b*) were parallel to the cross section of the acoustic tube (32), that is, the two opening ends 14 (14*a* and 14*b*) faced each other as in the arrangement of Example 1, and measurement was performed in the same manner as in Example 1.

Examples 8 to 11 and Comparative Example 1

In the same manner as in Example 7, the acoustic characteristics were measured with the distance between the opening portions 14 as 2 mm (Example 8), 3 mm (Example 9), 5 mm (Example 10), and 10 mm (Example 11).

Figure 25:
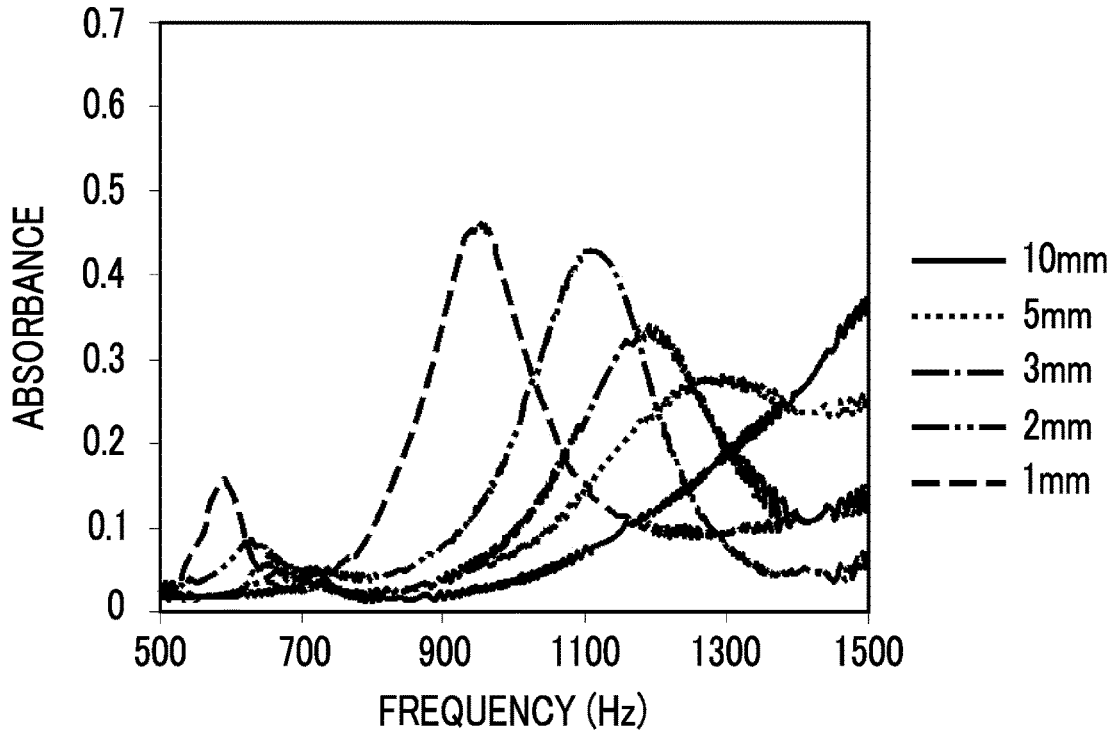
FIG. 25 is a graph showing the sound absorption characteristics of soundproof structures of Examples 7 to 11 of the present invention.
Figure 26:
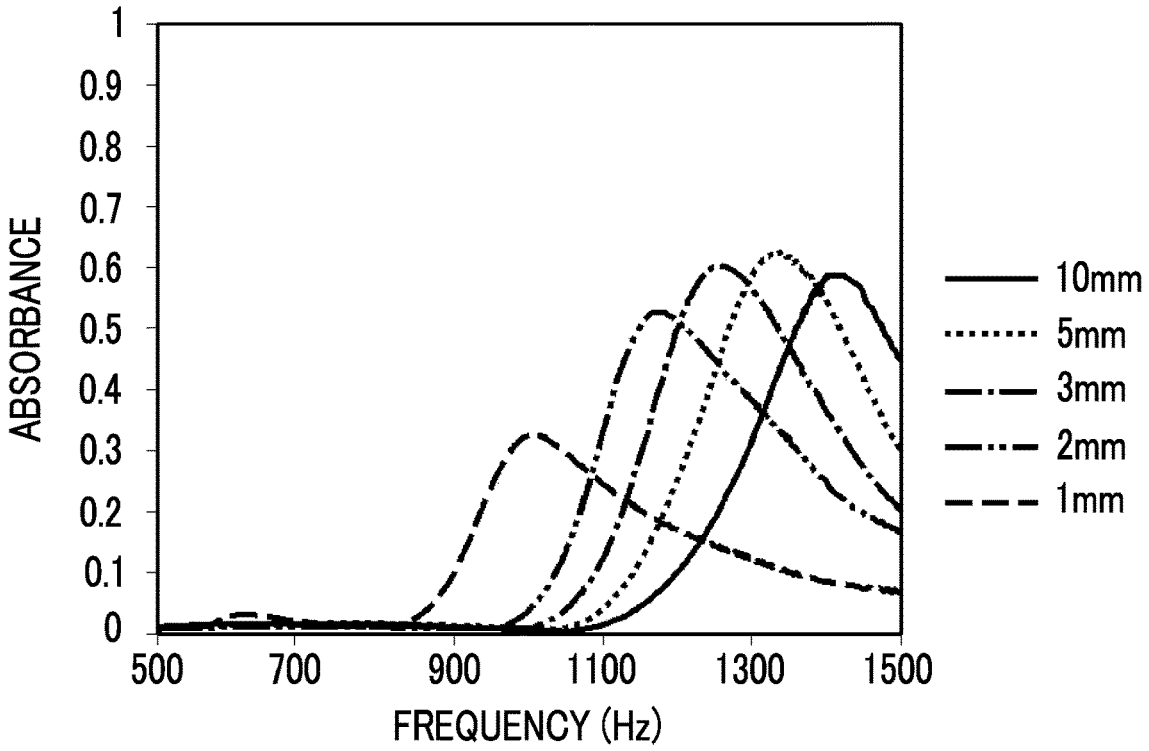
FIG. 26 is a graph showing the sound reflection characteristics of soundproof structures of Examples 7 to 11 of the present invention.

In the measurement of Reference example 2 and Examples 7 to 11, the transmittance and the reflectivity were measured in the same manner as in Example 1. In addition, the absorbance was calculated as (1−transmittance-reflectivity). The absorbance calculated in this manner is shown in FIG. 25, and the reflectivity is shown in FIG. 26.

The measurement results (absorption peak frequency and frequency difference from the single body) of Reference example 2 and Examples 7 to 11 are shown in Table 2.

TABLE 2

| | Distance (mm) | Absorption peak frequency | Frequency difference from single body |
|---|---|---|---|
| Example 7 | 1 | 958 | 1050 |
| Example 8 | 2 | 1102 | 906 |
| Example 9 | 3 | 1192 | 816 |
| Example 10 | 5 | 1294 | 714 |
| Example 11 | 10 | 1500 | 508 |
| Reference example 2 | Single body | 2008 | — |

As is apparent from FIGS. 25 and 26 and Table 2, also in Examples 7 to 11, it could be seen that the frequency peak was shifted to the lower frequency side as the distance became shorter as in Examples 1 to 6.

Focusing on absorption, it can be seen that another absorption peak appears at 590 Hz on the low frequency side particularly in a case where the distance is 1 mm. In the present invention, it has been shown that the air column resonance peak frequency is shifted to the low frequency side by reducing the distance between the opening portions 14 of the soundproof structures 10. In the soundproof structure according to the embodiment of the present invention, the length (frame thickness) Lt of the rectangular tube body 17 is large and the area (size) of the opening portion 14 is large. Accordingly, even in a cylindrical structure, end portions (frame portions) of the opening portions 14 of the rectangular tube bodies 17 in a case where the opening portions 14 are brought close to each other form a narrow slit shape. Therefore, it is considered that friction occurs in the slit portion, that is, a Helmholtz resonance phenomenon using the slit occurs. That is, by using the cylindrical structure, it is possible to use both soundproofing with high absorbance using the air column resonance frequency and slit Helmholtz resonance soundproofing using slit friction on the lower frequency side.

As described above, also in a soundproof unit having a larger cylindrical structure than that of Example 1, it could be seen that the absorption peak or the reflection peak due to the air column resonance phenomenon was shifted to the low frequency side by reducing the distance between the opening portions of the two soundproof units. In addition, since the shift amount depends on the distance, it could be seen that the soundproofing frequency control using the distance as a parameter could be easily performed.

Example 12

In the soundproof structure of Example 3, a frequency change in the case of shifting two cells (soundproof units 12*a* and 12*b* shown in FIG. 1) from each other in the translation direction was checked while keeping the distance (facing distance) between the opening portions facing each other at 2 mm instead of changing the distance between the opening portions of the soundproof units facing each other.

That is, as shown in FIG. 27, the soundproof structure 10d was manufactured by performing a shift of 5 mm in the translation direction for the example that was a case of complete overlap state at the facing distance of 2 mm (translational shift $\delta$=0 mm), and measurement was performed. In the soundproof structure 10*d*, the translational shift was performed in a direction parallel to the side of the square shape of the opening portion 14 (14*a* and 14*b*). In this case, since the opening portion 14 (14*a* and 14*b*) is a square with one side of 10 mm, the case of translational shift of 5 mm is a state in which there is an overlap of 5 mm between the opening portions 14 in the case of translational shift of 5 mm.

Figure 28:
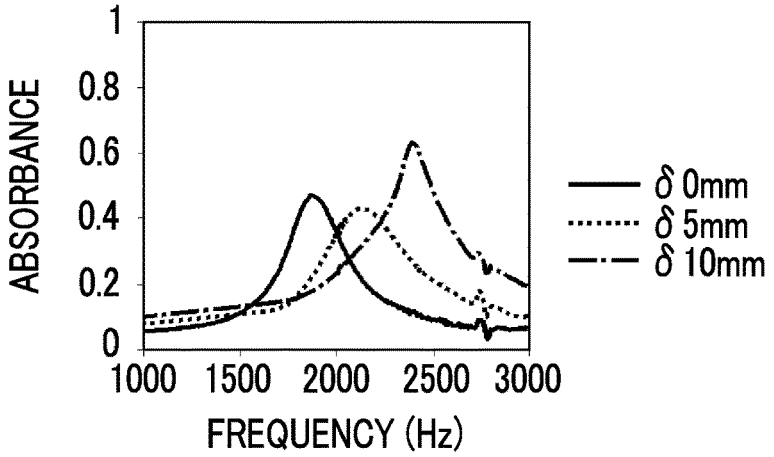
FIG. 28 is a graph showing the sound absorption characteristics of a soundproof structure of Example 12 of the present invention.

FIG. 28 and Table 3 summarize the measurement results. Compared with a single cell, shifting to the low frequency side occurs even in a case where there is a translational shift.

Comparative Example 2

In the same manner as in Example 3, the opening portion 14 (14*a* and 14*b*) is a square with one side of 10 mm, in which the facing distance is 2 mm and the translational shift $\delta$ is 10 mm. Under these conditions, there is no overlap between the opening portions 14. Measurement of the soundproof structure was performed, and the measurement results are summarized in FIG. 28 and Table 3. In Comparative example 2 in which the translational shift was large and there was no overlap between the opening portions 14, there was no shift to the low frequency side from the case of the single body.

As is apparent from the measurement results shown in FIG. 28 and Table 3, as long as there is an overlap between the opening portions 14 of the soundproof units 12, it can be seen that shifting to the low frequency side even in a facing structure, in which shifting in the translation direction occurs, and the large shift amount to the lowest frequency side are effective in a case where there is a large overlap between the opening portions 14.

From the above-described measurement results, it became obvious that the frequency could be adjusted by using a shift in the translation direction for the proximity structure instead of the facing distance between the opening portions 14 of the two soundproof units 12.

TABLE 3

| | Facing distance (mm) | Translational shift (mm) | Absorption peak frequency | Frequency difference from single body |
|---|---|---|---|---|
| Example 3 | 2 | 0 | 1880 | 545 |
| Example 12 | 2 | 5 | 2135 | 290 |
| Comparative Example 2 | 2 | 10 | 2425 | 0 |
| Reference example 1 | Single body | — | 2425 | — |

The soundproof system according to the embodiment of the present invention was checked.

The soundproof system 70 shown in FIG. 19, which caused absorption at an appropriate frequency by automatically adjusting the absorption frequency by adjusting the interlayer distance between the opening ends of the soundproof units with respect to the noise source, was manufactured.

As shown in FIG. 19, the configuration of the mike 72, the PC 74, and the device according to the embodiment of the present invention (soundproof structure 10 shown in FIG. 1) provided on the automatic stage 76 was adopted. As a soundproof structure, the sample used in Example 1 was used. First, the opening end proximity soundproof structure 10 was attached to the automatic stage 76 so that the distance between the opening ends could be adjusted by the automatic stage 76. The distance was adjusted by the automatic stage 76, and it was confirmed that the results of Examples 1 to 4 were reproduced.

In addition, by providing a feedback mechanism in the soundproof system 70, it was possible to construct an automatic muffling system without creating the correspondence table between the absorption frequency and the distance between the opening ends in advance. As a result, even in a case where the device characteristics were changed, the automatic muffling mechanism could be made to function.

From the above, the effects of the soundproof structure and the soundproof system according to the embodiment of the present invention are obvious.

Here, the soundproof structure according to the embodiment of the present invention is a soundproof structure using absorption by air column resonance that is more robust.

In contrast, the above-described JP3893053B discloses a sound absorption method using slit type Helmholtz resonance instead of absorption using air column resonance. In order to obtain the slit type Helmholtz resonance disclosed in JP3893053B, it is necessary to increase the friction in the slit portion by increasing the slit thickness or the like. For this reason, in the invention disclosed in JP3893053B, the structure is limited.

In this respect, the present invention uses absorption by air column resonance that is more robust. For this reason, compared with the slit Helmholtz that relies only on the slit portion friction for absorption as in the invention disclosed in JP3893053B, vibration of structure is less likely to affect absorption. In addition, compared with the slit Helmholtz structure in which it is necessary to increase the thickness of the side wall portion for friction, in the structure according to the embodiment of the present invention, it is not necessary to increase the thickness of the frame serving as a slit thickness as long as the side wall portion shields the sound. Therefore, the soundproof structure can be kept light.

From the viewpoint of controlling the frequency by the distance between the opening ends, the frequency shift of the air column resonance of the present invention is larger than the frequency shift amount of the slit Helmholtz resonance disclosed in JP3893053B. In addition, as can be seen in FIG. 25, in the case of slit Helmholtz resonance, an increase in the slit width rapidly reduces the friction, and accordingly absorption is almost eliminated. Therefore, in the case of the slit Helmholtz resonance, the width of the distance functioning in a case where the distance is changed is smaller than the air column resonance phenomenon of the present invention. Therefore, regarding the point of controlling various frequencies with a proximity distance, the present invention is advantageous.

Although JP3893053B discloses soundproofing according to a frequency using the slit Helmholtz phenomenon that is a friction phenomenon of an end portion slit by using the C-type channel structure, air column resonance does not appear since the channel structure is used. A resonance tube based on the concept of a cylindrical shape that causes air column resonance is used in the present invention, whereas a channel structure is used in JP3893053B. Accordingly, the present invention is structurally different.

In JP3893053B, considering the friction phenomenon, it is conceivable that the friction is increased and the resonance frequency is shifted by shortening the slit width of the slit Helmholtz. However, unlike in the present invention, it is not possible to shift the resonance frequency by bringing the opening portions, which are only a part of the size of the resonance tube, close to each other using the air column resonance that is a phenomenon of absorption in the entire resonance tube.

In the present invention, in the above-described Examples 7 and 8 and the like, a pattern in which slit Helmholtz resonance and air column resonance appear together is found. In the present invention, unlike the channel structure used in JP3893053B, broadband absorption in which two absorption peaks appear can be realized by forming the air column as a structure in which five surfaces of the rectangular tube body are closed.

The invention disclosed in JP3831263B is a technique for controlling the wavefront by arranging a plurality of one side closed rectangular tubes up to wavelength order instead of a single resonance cell formed by a one side closed rectangular tube, and the cell structure of a duct muffler requires the size of the wavelength order. For this reason, the invention disclosed in JP3831263B does not insulate sound by controlling the resonance frequency by interaction of two cells facing each other, unlike in the present invention. In addition, since the invention disclosed in JP3831263B is an invention for controlling the wavefront by arranging a number of cells, it is not possible to extract only a pair of cells forming a pair and bring the cells close to each other so that the two cells interact with each other.

In the invention disclosed in JP3831263B, it is necessary to create a wavefront at which the duct end portion becomes a soft boundary by securing the distance between air column resonance tubes. For this reason, in the invention disclosed in JP3831263B, in a case where there is an interaction between the air column resonance tubes facing each other as in the present invention, the wavefront is affected. Therefore, the invention disclosed in JP3831263B is an invention on the premise of use in a state in which the air column resonance tubes facing each other are separated from each other in a region where the interaction between the tubes is small (that is, a region where the duct is thick to some extent).

In addition, making the duct thin to bring the air column resonance tubes facing each other close to each other causes a phenomenon in which wind or heat hardly passes through the duct due to friction. Therefore, in the invention disclosed in JP3831263B, the air column resonance tubes are not brought close to each other unlike in the present invention.

The present invention is a method of absorption using a robust structure having a very strong air column resonance, and can be used in various fields, such as suppression of explosion sound inside the tunnel, other than duct resonance. In these fields, in particular, the problem of low frequency sound is a problem that the structure size is increased. Therefore, the shift to the low frequency and the frequency tuning of the present invention are advantageous in various fields.

While the soundproof structure and the soundproof system according to the embodiment of the present invention have been described in detail with reference to various embodiments and examples, the present invention is not limited to these embodiments and examples, and various improvements or modifications may be made without departing from the scope and spirit of the present invention.

EXPLANATION OF REFERENCES

10, 10*a*, 10*b*, 10*c*, 10*d*, 10*e*, 11, 11*a*, 11*b*, 30, 30*a*, 30*b*, 30*c*, 30*d*, 30*e*, 30*f*, 30*g*, 60, 80A, 80B, 90: soundproof structure

12, 12*a*, 12*b*, 12*c*, 12*d*, 12*e*, 12*f*, 12*g*: soundproof unit

13, 13*a*, 13*b*, 13*c*, 13*d*: inner space

14, 14*a*, 14*b*, 14*c*, 14*d*, 14*e*: opening portion (first opening portion)

15*a*, 15*d*: base end portion

15*b*: circular tube portion

15*c*, 15*e*: distal end portion

16, 16*a*, 16*b*, 16*c*, 16*d*, 16*e*, 16*f*, 16*g*: outer shell

17, 17*c*: rectangular tube body

17*a*: side plate-shaped member

17*b*: bent tube body

18, 18*a*, 18*b*, 18*c*: lid member

19: connection member

20: slit

22, 23: opening (second opening portion)

24: soundproof unit set

26: wall

28: soundproof wall

28*a*: soundproof wall structure

32: tubular member (acoustic tube)

32*a*: inner wall surface

33: hole portion

62: mounting table

64: traveling nut

66: drive screw

68: screw moving mechanism

70, 70*a*: soundproof system

72, 72*a*, 72*b*: microphone (mike)

74: personal computer (PC)

76: automatic stage

78: noise source

82: protruding portion

84: recessed portion

86: narrow portion

88: thick portion

92: protrusion

What is claimed is:

1. A soundproof structure, comprising:

two or more soundproof units, wherein each of the soundproof units has an outer shell having a cylindrical shape, has a hollow inner space inside the outer shell which is not filled with an acoustic material, and has a first opening portion opened to outside on a surface that is one end portion of the outer shell in an axis direction of the cylindrical shape and a second end portion opposite the one end portion, wherein the second end portion is a closed surface, the two soundproof units adjacent to each other are disposed in the axis direction such that the first opening portions face each other, the first opening portions facing each other are spaced apart from each other in the axis direction, and an average distance in the axis direction between the first opening portions facing each other is less than 20 mm, which is significantly less than a length L between the second end portion and the one end portion.

2. The soundproof structure according to claim 1, wherein a lid member that separates the inner space from the outside is provided on a surface that is the other end portion of the outer shell in the axis direction of the cylindrical shape.

3. The soundproof structure according to claim 2, wherein the lid member blocks the inner space of the outer shell from the outer space.

4. The soundproof structure according to claim 1, wherein a second opening portion smaller in size than the first opening portion is provided on a surface that is the other end portion of the outer shell in the axis direction of the cylindrical shape.

5. The soundproof structure according to claim 1, wherein the outer shell blocks the inner space is blocked from the outside except for two surfaces that are both end portions of the outer shell in the axis direction of the cylindrical shape.

6. The soundproof structure according to claim 1, wherein the outer shell has one or more second opening portions smaller in size than the first opening portions.

7. The soundproof structure according to claim 1, wherein the soundproof structure is a structure in which the inner space and the outside are connected to each other through the first opening portion so as to be able to transmit a gas propagating sound, and is a structure that causes a resonance phenomenon with respect to a sound flowing through the first opening portion.

8. The soundproof structure according to claim 7, wherein the soundproof unit causes air column resonance of an approximately closed tube with respect to sound, as the resonance phenomenon, by the inner space and the first opening portion.

9. The soundproof structure according to claim 1, wherein the outer shell of the soundproof unit is formed of the same material.

10. The soundproof structure according to claim 1, further comprising:

a duct-shaped member that has a space thereinside, wherein the two or more soundproof units are disposed inside the duct-shaped member.

11. The soundproof structure according to claim 1, wherein the two or more soundproof units are disposed on a wall.

12. The soundproof structure according to claim 1, further comprising:

a moving mechanism that moves the first opening portion of one of the two adjacent soundproof units relative to the first opening portion of the other soundproof unit, wherein the moving mechanism changes a distance between the first opening portions of the two adjacent soundproof units.

13. The soundproof structure according to claim 12, wherein the moving mechanism is a rail traveling mechanism comprising a rail and a wheel on which at least one of the two adjacent soundproof units is mounted and which travels on the rail.

14. The soundproof structure according to claim 12, wherein the moving mechanism is a screw moving mechanism, which comprises a ball screw and a nut to which at least one of the two adjacent soundproof units is attached and which is screwed to the ball screw, a rack to which at least one of the two adjacent soundproof units is attached and a rack and pinion mechanism with pinion engaged with the rack.

15. A soundproof system, comprising:

the soundproof structure according to claim 1;

a measurement unit that measures noise in a surrounding environment of the soundproof structure; and an analysis unit that analyzes a frequency of noise measured by the measurement unit, wherein a distance between the first opening portions of the two adjacent soundproof units is changed according to an analysis result of the analysis unit.

16. The soundproof system according to claim 15, wherein the soundproof mechanism is the soundproof structure according to claim 12, the moving mechanism is an automatic moving mechanism further comprising a driving source and a control unit that controls driving of the driving source, the analysis unit determines a movement amount of at least one of the two adjacent soundproof units according to the analysis result, and the control unit controls the driving of the driving source according to the determined movement amount to automatically move at least one of the two adjacent soundproof units such that a distance between the first opening portions of the two adjacent soundproof units is changed.

17. The soundproof system according to claim 16, further comprising:

a plurality of the measurement units, wherein the analysis unit analyzes the frequency of noise measured by each of the plurality of measurement units, and determines the movement amount of at least one of the two adjacent soundproof units according to the analysis result.

18. The soundproof structure according to claim 1, wherein a film that vibrates with respect to sound is not attached to the first opening portion.

19. The soundproof structure according to claim 1, wherein at least one of the soundproof units is formed by only a cylindrical outer shell.

20. The soundproof structure according to claim 1, wherein the soundproof structure absorbs sound using air column resonance.

* * * * *